US011813853B2

(12) United States Patent
Kawafuji et al.

(10) Patent No.: US 11,813,853 B2
(45) Date of Patent: Nov. 14, 2023

(54) PRINTING APPARATUS, CONTROL METHOD, AND CONVEYANCE APPARATUS

(71) Applicant: CANON KABUSHIKI KAISHA, Tokyo (JP)

(72) Inventors: Hiroshi Kawafuji, Kanagawa (JP); Hiroshi Taira, Tokyo (JP); Kazuhiko Sato, Tokyo (JP); Taku Yokozawa, Kanagawa (JP); Noboru Kunimine, Tokyo (JP); Akiko Aichi, Tokyo (JP); Satoshi Azuma, Tokyo (JP); Sae Mogi, Kanagawa (JP); Kei Yoshizawa, Kanagawa (JP); Shingo Nishioka, Kanagawa (JP); Junichi Saito, Kanagawa (JP); Hajime Nagai, Kanagawa (JP); Naoko Baba, Kanagawa (JP); Yuji Konno, Kanagawa (JP); Serena Yoshikawa, Kanagawa (JP); Satoshi Wada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 17/408,641

(22) Filed: Aug. 23, 2021

(65) Prior Publication Data

US 2022/0080754 A1 Mar. 17, 2022

(30) Foreign Application Priority Data

Sep. 17, 2020 (JP) ..... 2020-156363

(51) Int. Cl.
*B41J 11/70* (2006.01)
*B41J 11/66* (2006.01)

(52) U.S. Cl.
CPC ..... *B41J 11/663* (2013.01)

(58) Field of Classification Search
CPC ..... B41J 11/706; B41J 29/393; B41J 11/66; B41J 11/663; B41J 11/70; B41J 11/703;
(Continued)

(56) References Cited

U.S. PATENT DOCUMENTS 5,311,214 A 5/1994 Hirasawa et al.
5,832,184 A 11/1998 Konno et al.
(Continued)

FOREIGN PATENT DOCUMENTS

JP 2017-013438 A 1/2017
JP 2020163662 A * 10/2020

OTHER PUBLICATIONS

Maruyama, MachineTranslationofJP-2020163662-A, 2020 (Year: 2020).*

*Primary Examiner* — Scott A Richmond
(74) *Attorney, Agent, or Firm* — Venable LLP

(57) ABSTRACT

To provide a technology capable of appropriately suppressing deterioration in cutting accuracy of a slitter although the rigidity of a print medium changes, a printing apparatus is equipped with: a first conveyance unit configured to convey a print medium; a printing unit configured to print an image by applying ink to the print medium conveyed by the first conveyance unit; a cutting unit disposed on a downstream side in a conveyance direction in which the print medium is conveyed by the first conveyance unit and configured to cut the print medium, which is conveyed by the first conveyance unit, along the conveyance direction; and a second conveyance unit disposed on the cutting unit, and the printing apparatus includes a correction unit configured to correct a parameter related to conveyance of at least one of the first conveyance unit and the second conveyance unit, based on information about the print medium.

23 Claims, 21 Drawing Sheets

(58) Field of Classification Search
CPC .... B41J 13/00; B41J 13/0009; B41J 13/0027; B41J 13/0036; B41J 2029/3935; B41J 2203/00; B41J 2203/01; B41J 2203/011
See application file for complete search history.

(56) References Cited

U.S. PATENT DOCUMENTS

| | | | |
|---|---|---|---|
| 5,887,991 | A | 3/1999 | Narita et al. |
| 5,895,155 | A | 4/1999 | Narita et al. |
| 6,196,655 | B1 | 3/2001 | Hirasawa et al. |
| 6,334,659 | B1 | 1/2002 | Maeda et al. |
| 6,364,446 | B1 | 4/2002 | Ishikawa et al. |
| 6,572,212 | B2 | 6/2003 | Konno et al. |
| 6,580,460 | B1 | 6/2003 | Takahashi et al. |
| 6,729,709 | B2 | 5/2004 | Konno et al. |
| 6,733,100 | B1 | 5/2004 | Fujita et al. |
| 6,808,247 | B2 | 10/2004 | Kawatoko et al. |
| 6,827,413 | B1 | 12/2004 | Kawatoko et al. |
| 6,957,880 | B2 | 10/2005 | Kawatoko et al. |
| 6,960,036 | B1 | 11/2005 | Fujita et al. |
| 6,991,316 | B2 | 1/2006 | Maru et al. |
| 6,992,690 | B2 | 1/2006 | Mogi et al. |
| 7,044,592 | B2 | 5/2006 | Sato et al. |
| 7,057,756 | B2 | 6/2006 | Ogasahara et al. |
| 7,090,332 | B2 | 8/2006 | Konno et al. |
| 7,237,871 | B2 | 7/2007 | Yamaguchi et al. |
| 7,278,700 | B2 | 10/2007 | Yamaguchi et al. |
| 7,281,780 | B2 | 10/2007 | Nagamura et al. |
| 7,347,519 | B2 | 3/2008 | Nagamura et al. |
| 7,380,896 | B2 | 6/2008 | Wada |
| 7,399,049 | B2 | 7/2008 | Jahana |
| 7,431,426 | B2 | 10/2008 | Yamaguchi et al. |
| 7,517,044 | B2 | 4/2009 | Suzuki et al. |
| 7,537,310 | B2 | 5/2009 | Konno et al. |
| 7,552,996 | B2 | 6/2009 | Ochiai et al. |
| 7,585,039 | B2 | 9/2009 | Ochiai et al. |
| 7,726,763 | B2 | 6/2010 | Ochiai et al. |
| 7,758,154 | B2 | 7/2010 | Yokozawa |
| 7,775,622 | B2 | 8/2010 | Suzuki et al. |
| 7,789,476 | B2 | 9/2010 | Tomida et al. |
| 7,798,593 | B2 | 9/2010 | Nitta et al. |
| 7,819,497 | B2 | 10/2010 | Konno et al. |
| 7,891,754 | B2 | 2/2011 | Nagamura et al. |
| 7,963,623 | B2 | 6/2011 | Ochiai et al. |
| 7,980,649 | B2 | 7/2011 | Konno et al. |
| 7,980,652 | B2 | 7/2011 | Baba et al. |
| 8,057,009 | B2 | 11/2011 | Tomida et al. |
| 8,147,019 | B2 | 4/2012 | Fujita et al. |
| 8,210,638 | B2 | 7/2012 | Wada et al. |
| 8,240,795 | B2 | 8/2012 | Baba |
| 8,240,802 | B2 | 8/2012 | Nakano et al. |
| 8,251,480 | B2 | 8/2012 | Moriyama et al. |
| 8,287,074 | B2 | 10/2012 | Kano et al. |
| 8,342,649 | B2 | 1/2013 | Yazawa et al. |
| 8,366,230 | B2 | 2/2013 | Taira et al. |
| 8,430,472 | B2 | 4/2013 | Nishikori et al. |
| 8,444,246 | B2 | 5/2013 | Muro et al. |
| 8,454,110 | B2 | 6/2013 | Ochiai et al. |
| 8,485,620 | B2 | 7/2013 | Kitabatake et al. |
| 8,579,401 | B2 | 11/2013 | Iritani et al. |
| 8,371,673 | B2 | 12/2013 | Maru et al. |
| 8,608,271 | B2 | 12/2013 | Murayama et al. |
| 8,608,277 | B2 | 12/2013 | Tomida et al. |
| 8,622,501 | B2 | 1/2014 | Komamiya et al. |
| 8,628,163 | B2 | 1/2014 | Kanematsu et al. |
| 8,636,334 | B2 | 1/2014 | Nishioka et al. |
| 8,651,616 | B2 | 2/2014 | Maru et al. |
| 8,675,250 | B2 | 3/2014 | Muro et al. |
| 8,727,477 | B2 | 5/2014 | Kosaka et al. |
| 8,727,519 | B2 | 5/2014 | Nakagawa et al. |
| 8,733,874 | B2 | 5/2014 | Baba |
| 8,757,754 | B2 | 6/2014 | Azuma et al. |
| 8,783,832 | B2 | 7/2014 | Oonuki et al. |
| 8,845,060 | B2 | 9/2014 | Azuma et al. |
| 8,882,228 | B2 | 11/2014 | Ojiro et al. |
| 8,888,204 | B2 | 11/2014 | Iritani et al. |
| 8,888,223 | B2 | 11/2014 | Oonuki et al. |
| 8,931,869 | B2 | 1/2015 | Kawafuji |
| 8,950,843 | B2 | 2/2015 | Oikawa et al. |
| 8,950,844 | B2 | 2/2015 | Takahashi et al. |
| 9,007,653 | B2 | 4/2015 | Ojiro et al. |
| 9,028,029 | B2 | 5/2015 | Azuma et al. |
| 9,028,049 | B2 | 5/2015 | Azuma et al. |
| 9,033,471 | B2 | 5/2015 | Oonuki et al. |
| 9,039,112 | B2 | 5/2015 | Murayama et al. |
| 9,039,120 | B2 | 5/2015 | Nishioka |
| 9,039,157 | B2 | 5/2015 | Ogata et al. |
| 9,044,947 | B2 | 6/2015 | Wada et al. |
| 9,079,421 | B2 | 7/2015 | Kato et al. |
| 9,108,409 | B2 | 8/2015 | Suzuki et al. |
| 9,114,631 | B2 | 8/2015 | Fujita et al. |
| 9,120,304 | B2 | 9/2015 | Konno et al. |
| 9,126,403 | B2 | 9/2015 | Ojiro et al. |
| 9,211,748 | B2 | 12/2015 | Baba et al. |
| 9,227,423 | B2 | 1/2016 | Yazawa et al. |
| 9,308,741 | B2 | 4/2016 | Wada et al. |
| 9,340,009 | B2 | 5/2016 | Murayama et al. |
| 9,434,196 | B2 | 9/2016 | Fukasawa et al. |
| 9,457,586 | B2 | 10/2016 | Fujita et al. |
| 9,545,791 | B2 | 1/2017 | Oonuki et al. |
| 9,889,649 | B2 | 2/2018 | Baba et al. |
| 10,668,717 | B2 | 6/2020 | Azuma et al. |
| 11,077,687 | B2 | 8/2021 | Nishioka et al. |
| 2009/0021548 | A1 | 1/2009 | Suzuki et al. |
| 2011/0032296 | A1 | 2/2011 | Nakano et al. |
| 2012/0033006 | A1 | 2/2012 | Murayama et al. |
| 2012/0069067 | A1 | 3/2012 | Torigoe et al. |
| 2013/0235107 | A1 | 9/2013 | Ibe et al. |
| 2014/0375717 | A1 | 12/2014 | Yazawa et al. |
| 2020/0290367 | A1 | 9/2020 | Kawafuji |
| 2021/0026283 | A1 | 1/2021 | Baba |
| 2021/0060982 | A1 | 3/2021 | Genta et al. |
| 2021/0300031 | A1 | 9/2021 | Kawafuji et al. |

* cited by examiner

| AMOUNT OF SHIFT FROM THE CONVEYANCE COMMAND VALUE L | DRIVING AMOUNT OF THE SLITTER DRIVING MOTOR | DRIVING AMOUNT OF THE CONVEYANCE MOTOR |
|---|---|---|
| −X | (1 + kX / L) S | (1 + mX / L) T |
| 0 | S | T |
| +X | (1 − kX / L) S | (1 − mX / L) T |

FIG.13

| PRINT MEDIUM TYPE | PRINTING DUTY D (%) OF THE CUTTING AREA | CONVEYANCE SPEED RATIO P | ROTATION SPEED T1 [$s^{-1}$] OF THE CONVEYANCE ROLLER | ROTATION SPEED T2 [$s^{-1}$] OF THE SLITTER UPPER CONVEYANCE ROLLER |
|---|---|---|---|---|
| GLOSSY PAPER | $0 \leqq D < 100$ | 1.00 | 2.00 | 2.00 |
| | $100 \leqq D < 150$ | 1.01 | 2.00 | 2.02 |
| | $150 \leqq D$ | 1.02 | 2.00 | 2.04 |
| COATED PAPER | $0 \leqq D < 100$ | 1.01 | 2.00 | 2.02 |
| | $100 \leqq D < 150$ | 1.02 | 2.00 | 2.04 |
| | $150 \leqq D$ | 1.03 | 2.00 | 2.06 |
| ORDINARY PAPER | $0 \leqq D < 100$ | 1.02 | 2.00 | 2.04 |
| | $100 \leqq D < 150$ | 1.03 | 2.00 | 2.06 |
| | $150 \leqq D$ | 1.04 | 2.00 | 2.08 |

| FIG.16A |
| --- |
| FIG.16B |

1702

| PRINT MEDIUM TYPE | PRINTING DUTY Dn (%) OF THE CUTTING AREA | CONVEYANCE SPEED RATIO P | ROTATION SPEED T1 [$s^{-1}$] OF THE CONVEYANCE ROLLER | ROTATION SPEED T2 [$s^{-1}$] OF THE SLITTER UPPER CONVEYANCE ROLLER |
|---|---|---|---|---|
| GLOSSY PAPER | $0 \leqq Dn < 100$ | 1.00 | 2.00 | 2.00 |
| | $100 \leqq Dn < 150$ | 1.01 | 2.00 | 2.02 |
| | $150 \leqq Dn$ | 1.02 | 2.00 | 2.04 |
| COATED PAPER | $0 \leqq Dn < 100$ | 1.01 | 2.00 | 2.02 |
| | $100 \leqq Dn < 150$ | 1.02 | 2.00 | 2.04 |
| | $150 \leqq Dn$ | 1.03 | 2.00 | 2.06 |
| ORDINARY PAPER | $0 \leqq Dn < 100$ | 1.02 | 2.00 | 2.04 |
| | $100 \leqq Dn < 150$ | 1.03 | 2.00 | 2.06 |
| | $150 \leqq Dn$ | 1.04 | 2.00 | 2.08 |

| PRINT MEDIUM TYPE | MARGIN SETTING | CONVEYANCE SPEED RATIO P | ROTATION SPEED T1 [$s^{-1}$] OF THE CONVEYANCE ROLLE | ROTATION SPEED T2 [$s^{-1}$] OF THE SLITTER UPPER CONVEYANCE ROLLER |
|---|---|---|---|---|
| GLOSSY PAPER | WITH-MARGIN | 1.00 | 2.00 | 2.00 |
| | MARGINLESS | 1.02 | 2.00 | 2.04 |
| COATED PAPER | WITH-MARGIN | 1.01 | 2.00 | 2.02 |
| | MARGINLESS | 1.03 | 2.00 | 2.06 |
| ORDINARY PAPER | WITH-MARGIN | 1.02 | 2.00 | 2.04 |
| | MARGINLESS | 1.04 | 2.00 | 2.08 |

FIG.20

PRINTING APPARATUS, CONTROL METHOD, AND CONVEYANCE APPARATUS

BACKGROUND OF THE INVENTION

Field of the Invention

The present invention relates to a printing apparatus and conveyance apparatus that are capable of cutting a conveyed sheet-shaped print medium, and to a control method of the printing apparatus.

Description of the Related Art

Japanese Patent Laid-Open No. 2017-13438 discloses a technology related to a printing apparatus which is equipped with a slitter for cutting a printed print medium along the conveyance direction of the print medium. Specifically, according to the printing apparatus disclosed in Japanese Patent Laid-Open No. 2017-13438, the leading edge of a conveyed print medium is inserted to a blade part of the slitter, so that the print medium is cut along the conveyance direction in accordance with conveyance of the print medium.

Further, the technology disclosed in Japanese Patent Laid-Open No. 2017-13438 has a configuration in which, of the rollers that convey the print medium, the rotation speed of the roller at a downstream position of the slitter becomes faster by a predetermined amount than that of the roller at an upstream position of the slitter. Accordingly, it is considered that a tension is applied to the print medium that is cut by the slitter and thus deterioration in the cutting accuracy of the slitter is suppressed.

However, the rigidity of the print medium changes depending on various conditions such as the type of print medium, the application amount of ink, the external environment such as temperature and humidity, etc. Due to such a change in rigidity of the print medium, it becomes impossible to obtain the tension required to maintain preferable cutting accuracy, which causes the print medium to float or bend, and thus there has been a possibility that the cutting accuracy of the slitter is deteriorated.

SUMMARY OF THE INVENTION

The present invention has been made in view of the above-described problems, so as to provide a technology capable of appropriately suppressing deterioration in cutting accuracy of a slitter although the rigidity of a print medium changes.

In the first aspect of the present invention, there is provided a printing apparatus including:

- a first conveyance unit configured to convey a print medium;
- a printing unit configured to print an image by applying ink to the print medium conveyed by the first conveyance unit;
- a cutting unit disposed on a downstream side in a conveyance direction in which the print medium is conveyed by the first conveyance unit and configured to cut the print medium, which is conveyed by the first conveyance unit, along the conveyance direction; and
- a second conveyance unit disposed on the cutting unit, the printing apparatus including

- a correction unit configured to correct a parameter related to conveyance of at least one of the first conveyance unit and the second conveyance unit, based on information about the print medium.

In the second aspect of the present invention, there is provided a control method of a printing apparatus including: a first conveyance unit configured to convey a print medium; a printing unit configured to print an image on the print medium conveyed by the first conveyance unit; a cutting unit disposed on a downstream side in a conveyance direction in which the print medium is conveyed by the first conveyance unit and configured to cut the print medium, which is conveyed by the first conveyance unit, along the conveyance direction; and a second conveyance unit disposed on the cutting unit, the control method including

- a correction step for correcting a parameter related to conveyance of at least one of the first conveyance unit and the second conveyance unit, based on information about the print medium.

In the third aspect of the present invention, there is provided a conveyance apparatus including:

- a first conveyance unit configured to convey a print medium;
- a cutting unit disposed on a downstream side in a conveyance direction in which the print medium is conveyed by the first conveyance unit and configured to cut the print medium, which is conveyed by the first conveyance unit, along the conveyance direction; and
- a second conveyance unit disposed on the cutting unit, the conveyance apparatus including

- a correction unit configured to correct a parameter related to conveyance of at least one of the first conveyance unit and the second conveyance unit, based on information about the print medium.

According to the present invention, it becomes possible to appropriately suppress deterioration in cutting accuracy of a slitter.

Further features of the present invention will become apparent from the following description of exemplary embodiments with reference to the attached drawings.

BRIEF DESCRIPTION OF THE DRAWINGS

FIG. 13 is a diagram illustrating calculation formulas for calculating a driving amount according to an adjustment;

FIG. 20 is a diagram for explaining the method of determining the rotation speed of each conveyance roller in the print processing of FIG. 19.

DESCRIPTION OF THE EMBODIMENTS

Hereinafter, with reference to the attached drawings, a detailed explanation will be given of an example of a printing apparatus, a control method of the printing apparatus, and a conveyance apparatus according to the present embodiments. Note that it is not intended that the following embodiments limit the present invention, and every combination of the characteristics explained in the embodiments is not necessarily essential to the solutions in the present invention. In addition, unless otherwise specified, the relative positions, shapes, etc., of the constituent elements described in the present embodiments are merely examples and are not intended to limit the range of this invention thereto.

Note that, in the following explanations, "printing" includes, not only a case of forming meaningful information such as a letter or a figure, but also a case of forming an image, a design, a pattern, etc., on a print medium in a broad sense regardless of being meaningful or meaningless or a case of processing a medium. Further, whether to be actualized in such a manner that a human can visually perceive or not does not matter. Furthermore, although it is assumed that the "print medium" is a print medium in the embodiments, a cut sheet, a cloth, a plastic film, etc., are also possible.

First Embodiment

Figure 1:
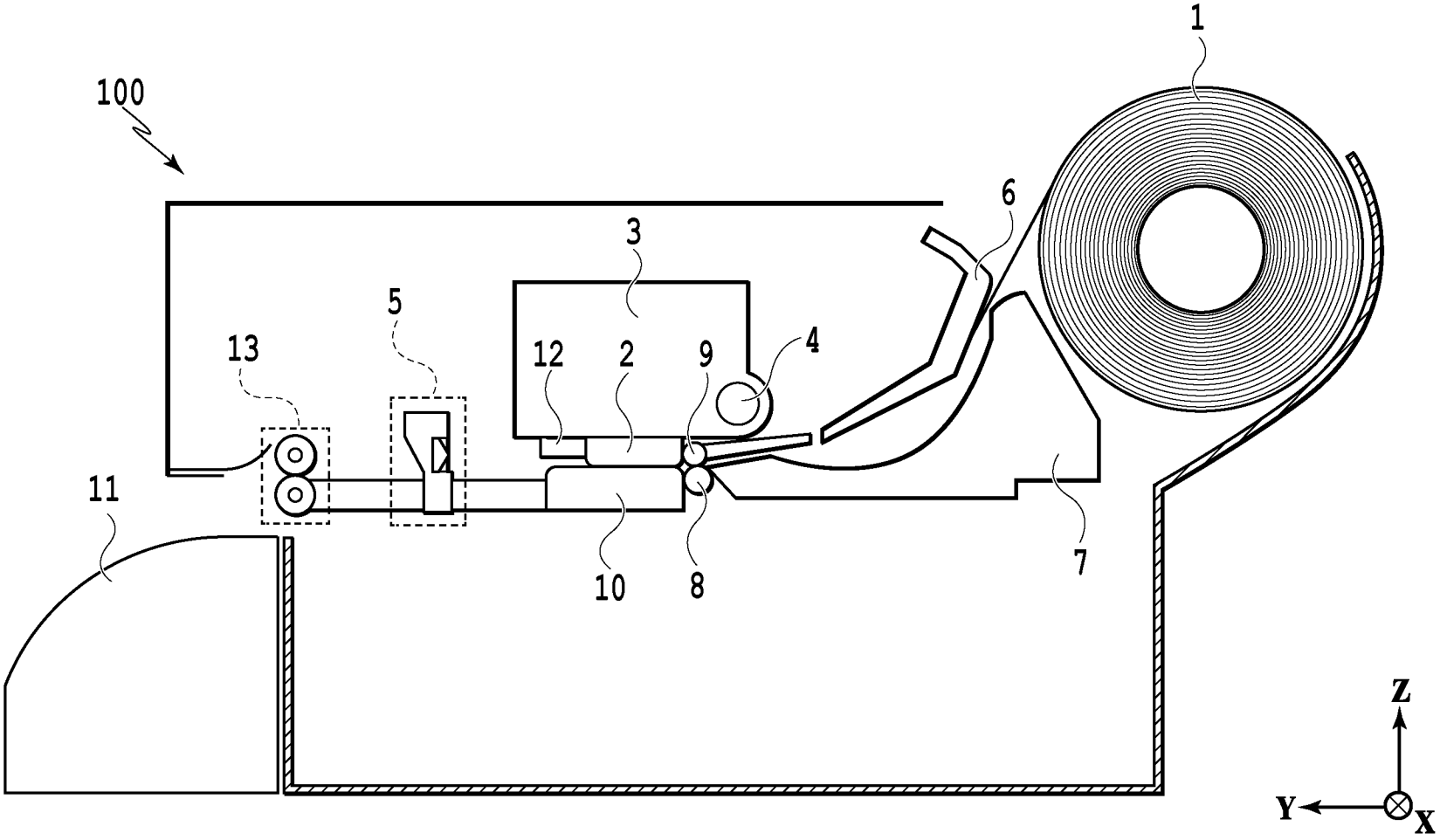
FIG. 1 is a schematic configuration diagram of a printing apparatus.

First, with reference to FIG. 1 through FIG. 13, an explanation will be given of a printing apparatus according to the first embodiment. FIG. 1 is a schematic configuration diagram of a printing apparatus according to an embodiment.

<Overall Configuration of the Printing Apparatus>

The printing apparatus 100 of FIG. 1 is an inkjet printing apparatus that applies ink to a long sheet-shaped print medium for printing, based on job data which is output from a host apparatus (not illustrated in the drawings). In the present embodiment, the printing apparatus 100 holds a roll which is formed by winding the long sheet-shaped print medium 1. The print medium 1 unwound from the roll is conveyed downstream through a conveyance path formed by the upper guide 6 and the lower guide 7. Thereafter, the print medium 1 is nipped by the conveyance roller 8 and the pinch roller 9 and conveyed to an image printing part. The image printing part is equipped with the print head 2, the carriage 3 on which the print head 2 is mounted, and the platen 10 arranged at a position facing the print head 2. The print medium 1 is conveyed onto the platen 10 by the conveyance roller 8. In the image printing part, ink ejected from the print head 2 is applied to the print medium 1 which is conveyed onto the platen 10, so that an image is printed.

The carriage 3 is supported so as to be capable of performing a sliding motion by the guide shaft 4, which extends in the X direction that intersects (orthogonally in the present embodiment) the Y direction which is the conveyance direction of the print medium 1, and by a guide rail (not illustrated in the drawing), which is disposed so as to be parallel to the guide shaft 4. Further, the carriage 3 is equipped with the reflection type detection sensor 12 facing the platen 10 on the downstream side relative to the print head 2 in the conveyance direction of the print medium 1.

Accordingly, the carriage 3 is configured to be capable of performing scanning, i.e., reciprocating, in the X direction along the guide shaft 4 while holding the print head 2. Further, when the carriage 3 is performing scanning in the X direction, ink is ejected from the print head 2, so that the ink is applied to the print medium 1 for printing. In this way, in the present embodiment, the print head 2 functions as a printing unit that performs printing on a print medium.

The printing apparatus 100 makes the print head 2 perform scanning in the X direction via the carriage 3 in order to perform printing on the print medium 1, then conveys the print medium 1 by a predetermined amount with the conveyance roller 8, and then makes the print head 2 perform scanning again via the carriage 3 in order to perform printing on the print medium 1. In this way, in the printing apparatus 100, the printing operation, in which the print head 2 is made to perform scanning in the X direction for printing, and the conveyance operation, in which the print medium 1 is conveyed by a predetermined amount in the conveyance direction, are repeatedly executed, so that a printed image based on image data will thereby be printed on the print medium 1.

As will be described in detail later, the detection sensor 12 has a configuration capable of detecting the reflectivity at a spot position. Therefore, in a case where the platen 10 is black and the print medium 1 is white, the reflectivity of the two are significantly different, and thus, based on a detection result of the detection sensor 12, the leading edge portion of the conveyed print medium 1 in the conveyance direction can be detected. Further, since the detection sensor 12 is mounted on the carriage 3, the position of an end portion of the print medium 1 in the width direction (the X direction) can be detected by the reciprocal movement of the carriage 3 in the X direction.

The cutter 5 for cutting the print medium 1 in the X direction is disposed on the downstream side relative to the carriage 3 in the conveyance direction of the print medium 1. Further, the slitter 13 for cutting the print medium 1 along the conveyance direction is disposed on the downstream side relative to the cutter 5 in the conveyance direction. The discharge guide 11 for discharging the cut print medium 1 is disposed on the downstream side relative to this slitter 13 in the conveyance direction.

<Configuration of the Print Head>

Figure 2:
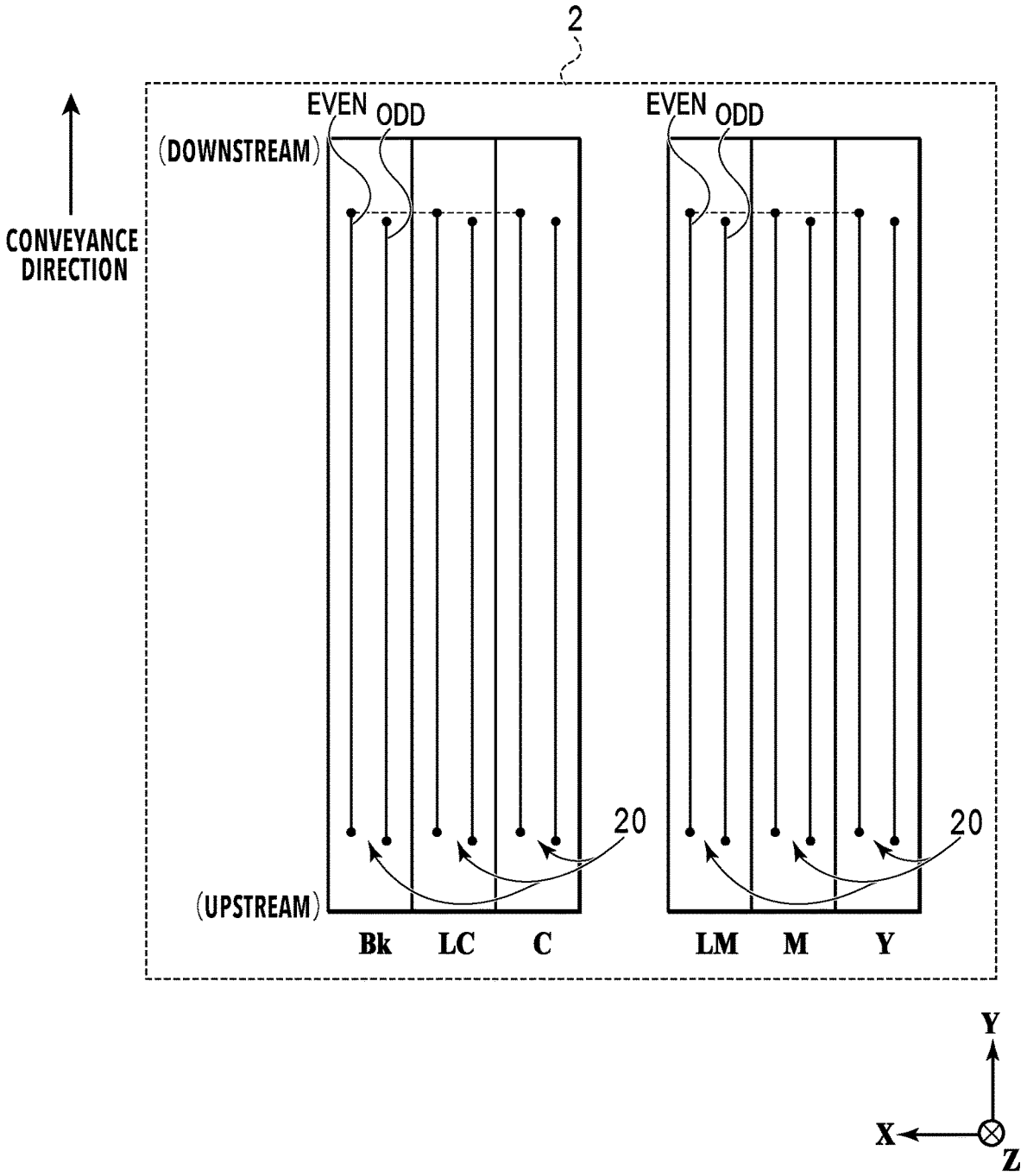
FIG. 2 is a schematic view of a nozzle plane of a print head.

FIG. 2 is a diagram schematically illustrating a nozzle plane of the print head 2 on which nozzles for ejecting ink are formed. The print head 2 has a configuration capable of ejecting ink of six colors, i.e., black (Bk), light cyan (LC), cyan (C), light magenta (LM), magenta (M), and yellow (Y). The print head 2 is equipped with the nozzle rows 20 in which multiple nozzles that eject ink are aligned along the Y direction for each color. These nozzle rows 20 are formed with EVEN rows and ODD rows disposed at predetermined intervals in the X direction.

The EVEN rows and the ODD rows respectively have 640 nozzles aligned at a resolution of 600 dpi in the Y direction, which is the conveyance direction of the print medium 1. Further, the EVEN rows are arranged so as to be shifted from the ODD rows by 1/1200 inch in the Y direction. Therefore, in each of the nozzle rows 20, the resolution in the Y direction when printing is performed by utilizing both an EVEN row and an ODD row is 1200 dpi.

The types and numbers of inks that can be ejected from the print head 2 are not limited to the six colors described above. Further, in the following explanation, the print head 2 in which the nozzle rows 20 for ejecting ink of the respective colors are configured with the EVEN rows and the ODD rows will be used for the explanation. However, the present embodiment can be applied to a print head in which the nozzle rows 20 for ejecting ink of the respective colors are configured with single nozzle rows as well if it is assumed that the odd-numbered nozzles and the even-numbered nozzles are respectively an ODD row and an EVEN row.

<Configuration of the Detection Sensor>

Figure 3B:
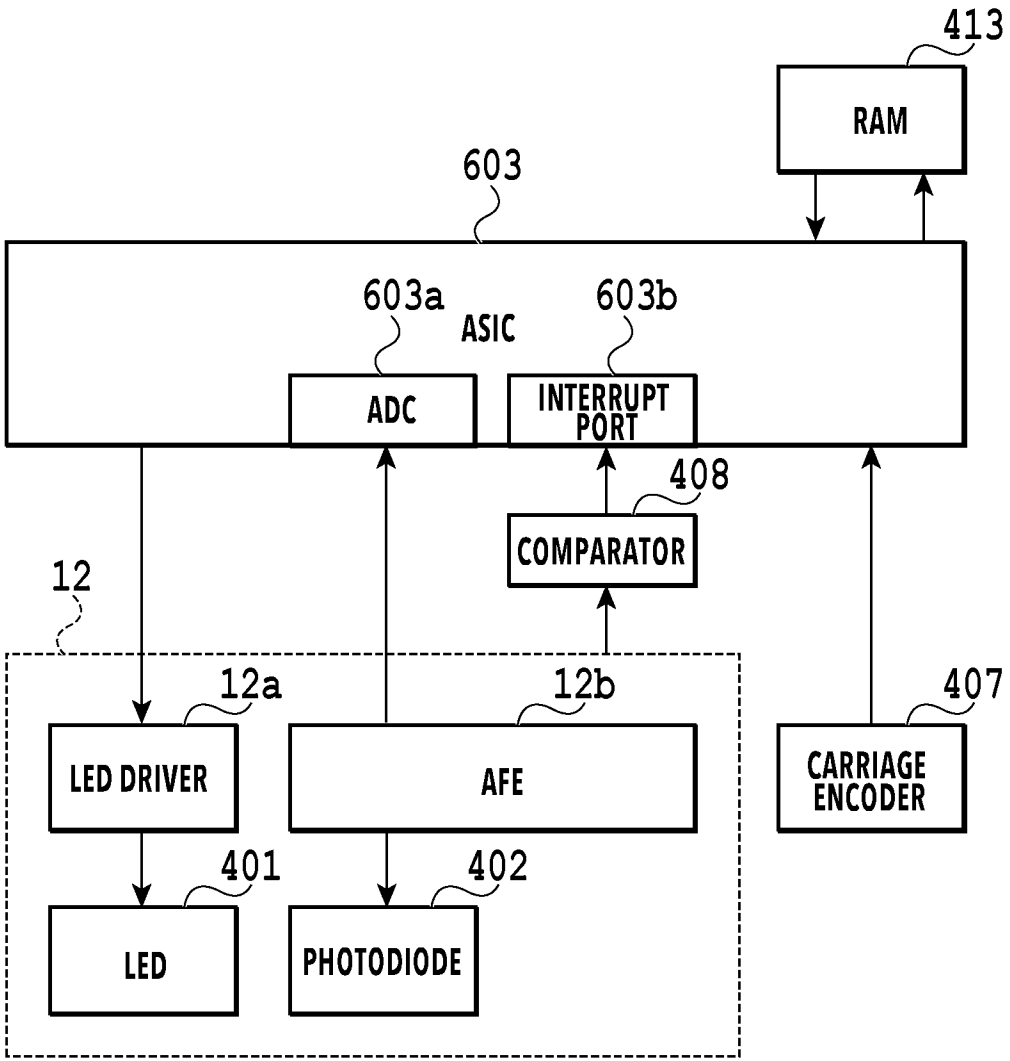
FIG. 3A and FIG. 3B are diagrams for explaining a configuration of a detection sensor.
Figure 3A:
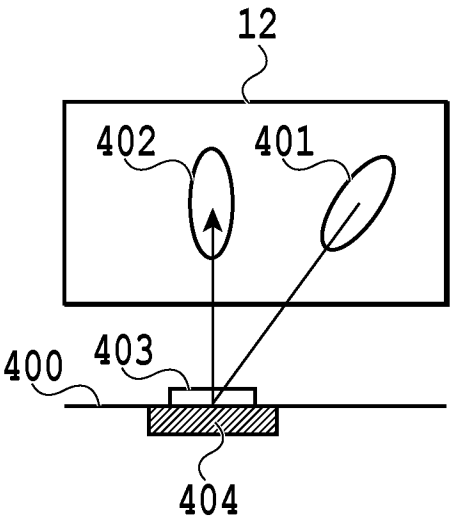

FIG. 3A and FIG. 3B are diagrams for explaining the configuration of the detection sensor 12. FIG. 3A is a schematic configuration diagram of the detection sensor 12, and FIG. 3B is a block diagram including a control configuration of the detection sensor 12.

The detection sensor 12 includes the LED 401, which irradiates the printing surface 400 of the print medium 1 to which the ink ejected from the print head 2 is applied with light, and the photodiode 402, which receives the reflected light from the printing surface 400. The irradiation area of the irradiation light from the LED 401 and the detection area of the photodiode 402 overlap each other on the reflection surface (i.e., the printing surface 400), so as to form the detection spot 403. The size of the detection spot 403 is, for example, 5 mm×5 mm. In a case where the pattern 404 which is printed on the printing surface 400 is irradiated with light from the LED 401, the level of reflection intensity, which reflects the printing density of the pattern 404, can be detected via the photodiode 402. The reflection intensity becomes stronger on a white print medium and becomes weaker on a pattern with a high printing density.

In the printing apparatus 100, the ASIC 603 disposed in the control part 410 (which will be described later) controls the operation of the detection sensor 12. The LED 401 can selectively emit the three primary colors, i.e., R (red), G (green), and B (blue), and is controlled by the LED driver 12*a* according to the color of the detection-target pattern.

On a light-reception signal from the photodiode 402, a low-pass filtering process for noise removal and a signal amplification process are performed with the analog processing part (AFE: Analog Front-End) 12*b*. The processed analog signal is input to the ASIC 603 as a digital signal via the ADC (A/D Converter) 603*a* of the ASIC 603. Further, the processed analog signal is input to the comparator 408, and the output of the comparator is input to the interrupt port 603*b* of the ASIC 603 as an interrupt signal.

The printing apparatus 100 is equipped with the carriage encoder 407 for detecting the position of the carriage 3, and a signal from this carriage encoder 407 is input to the ASIC 603. The ASIC 603 synchronizes an output signal from the detection sensor 12 and a position signal from the carriage encoder 407 in cooperation with the CPU 411 of the control part 410, so as to process the signal from the detection sensor 12 as a density detection signal corresponding to the position of the carriage 3. Further, the RAM 413 (which will be described later) is connected to the ASIC 603, and this RAM 413 stores the data of a read pattern, a count value which is output from the carriage encoder 407, etc.

<Configuration of the Cutter>

Figure 4:
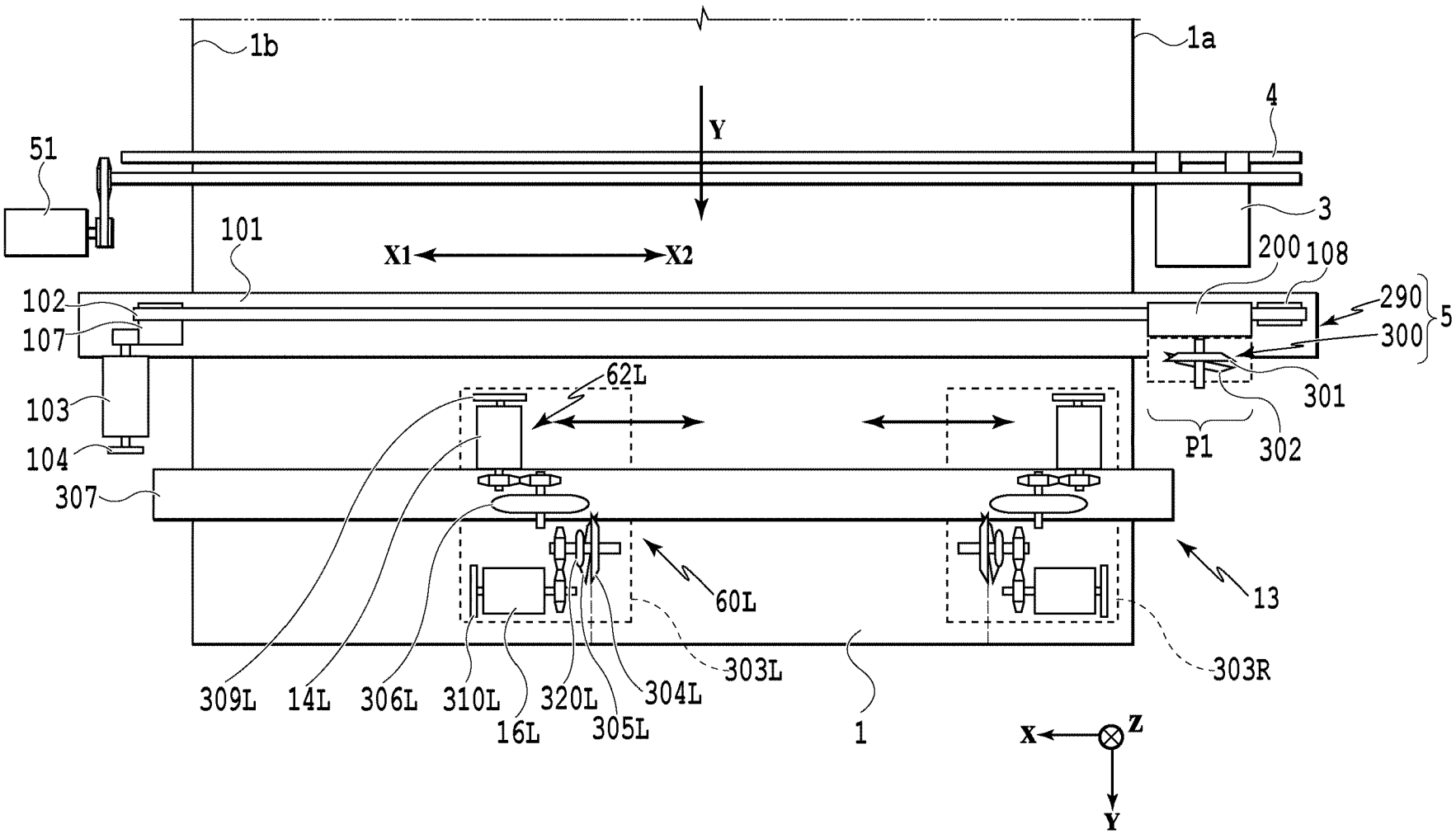
FIG. 4 is a schematic configuration diagram in the vicinity of a cutter and a slitter.

FIG. 4 is a schematic configuration diagram of the vicinity of the cutter 5 and the slitter 13 of the printing apparatus 100. In the present specification, "L" and "R" at the end of reference signs indicate a member on the left side (i.e., the +X side) of the drawing and a member on the right side (i.e., the −X side) of the drawing, respectively. In the present specification, such an end of a reference sign may be omitted for members that are the same on the left side and the right side.

The cutter 5 is equipped with the cutter unit 300, which is a cutting part that cuts the print medium 1 in the X direction, and the moving unit 290, which is a moving part that moves the cutter unit 300 along the X direction.

The moving unit 290 is equipped with the cutter carriage 200, which is disposed on the guide rail 101 extending in the X direction so as to be capable of performing a sliding motion. The cutter carriage 200 is equipped with the cutter unit 300 and the belt 102. The belt 102 is in an endless shape wrapped around the motor pulley 107 and the tensioner pulley 108 disposed in the vicinity of the left and right end portions of the guide rail 101. Further, the belt 102 is configured to be movable by driving of the cutter motor 103 which is connected to the motor pulley 107.

The cutter motor 103 is equipped with the cutter encoder 104. The cutter encoder 104 counts the number of pulses corresponding to driving of the cutter motor 103. Based on the origin position of the cutter carriage 200 and the number of pulses obtained by the cutter encoder 104, the later-described control part 410 controls the movement position of the cutter unit 300 in the X1 and X2 directions.

The cutter unit 300 includes the upper movable blade 301 and the lower movable blade 302, so that the print medium 1 is cut at the contact point therebetween while the cutter unit 300 moves in the X direction. Further, the upper movable blade 301 and the lower movable blade 302 are connected to the cutter motor 103 via the belt 102 and the cutter carriage 200. Therefore, the upper movable blade 301 and the lower movable blade 302 are configured to be rotationally drivable by driving of the cutter motor 103.

In a case where the print medium 1 is cut, the print medium 1 is cut while the lower movable blade 302 and the upper movable blade 301, which is in contact with the lower movable blade, rotate together. In FIG. 4, the cutter unit 300 performs cutting from the first end portion 1*a* of a print medium to the second end portion 1*b* of the print medium. The first end portion 1*a* of the print medium is an end portion on the stand-by position P1 side of the cutter unit 300. After the print medium 1 is cut, the cutter carriage 200 is reversed at a predetermined reversing position and moves to a position which is the stand-by position P1, in order to stand by for the next cutting operation. Note that, although the cutter unit 300 is mounted on the cutter carriage 200 in the example of the present embodiment, it is also possible that the cutter unit 300 is mounted on the carriage 3, on which the print head 2 is mounted, for example.

<Configuration of the Slitter>

The slitter 13 is disposed on the downstream side relative to the cutter 5 in the conveyance direction of the print medium 1. The slitter 13 includes the slitter unit 303 which is disposed in a movable manner on the slitter guide rail 307 extending in the X direction (see FIG. 4). This slitter unit 303 is movable to a given position in the X1 and X2 directions and is capable of cutting the print medium 1 along a direction parallel to the conveyance direction (the +Y direction).

In the present embodiment, the slitter 13 has a configuration in which the two slitter units 303L and 303R are mounted. Note that the slitter units 303L and 303R are configured to be left-right reversals in the X1 and X2 directions with the same components. Therefore, in FIG. 4, the reference signs are mainly given to the components of the slitter unit 303L for the sake of simplification.

Figure 5A:
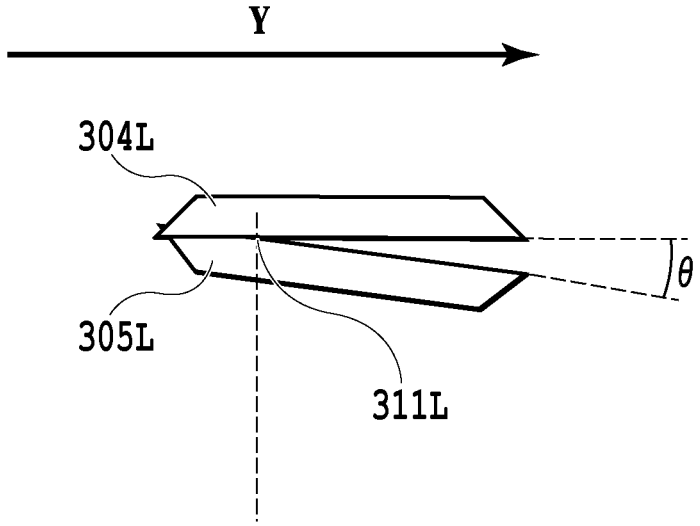
FIG. 5A and FIG. 5B are diagrams illustrating a relationship between an upper movable blade and a lower movable blade in a slitter unit.
Figure 5B:
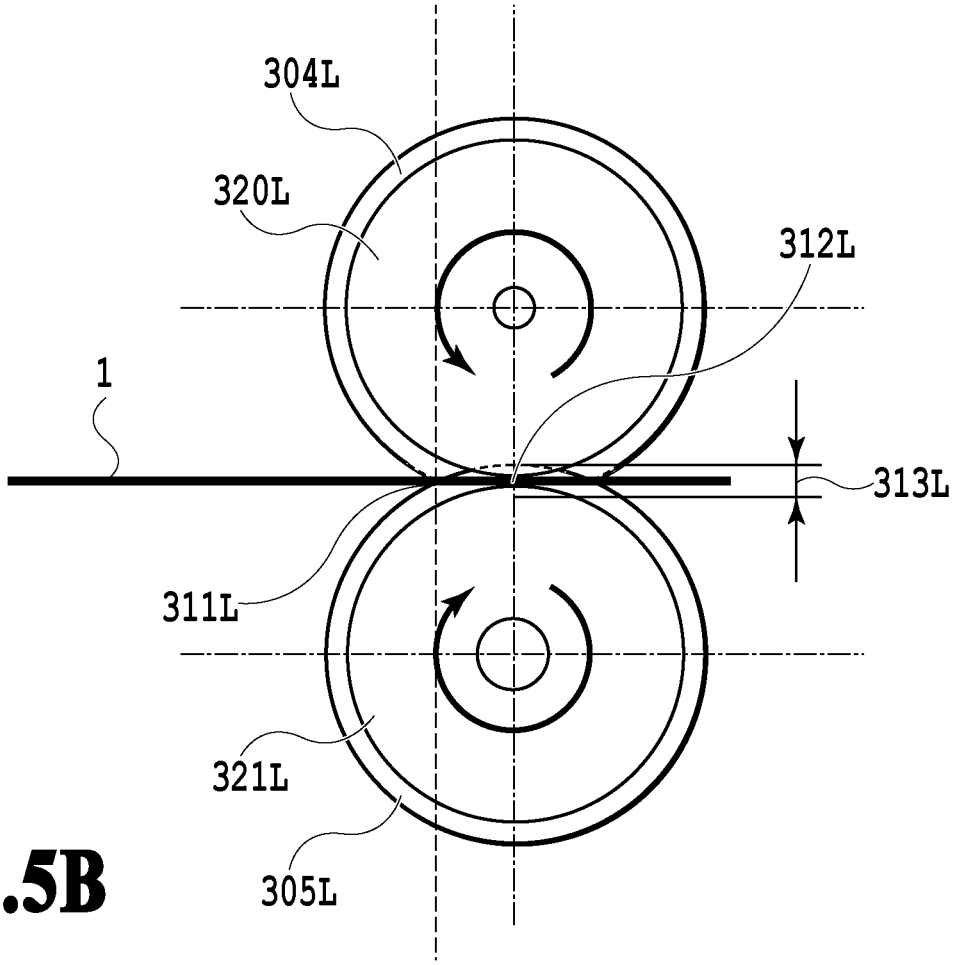
Figure 6:
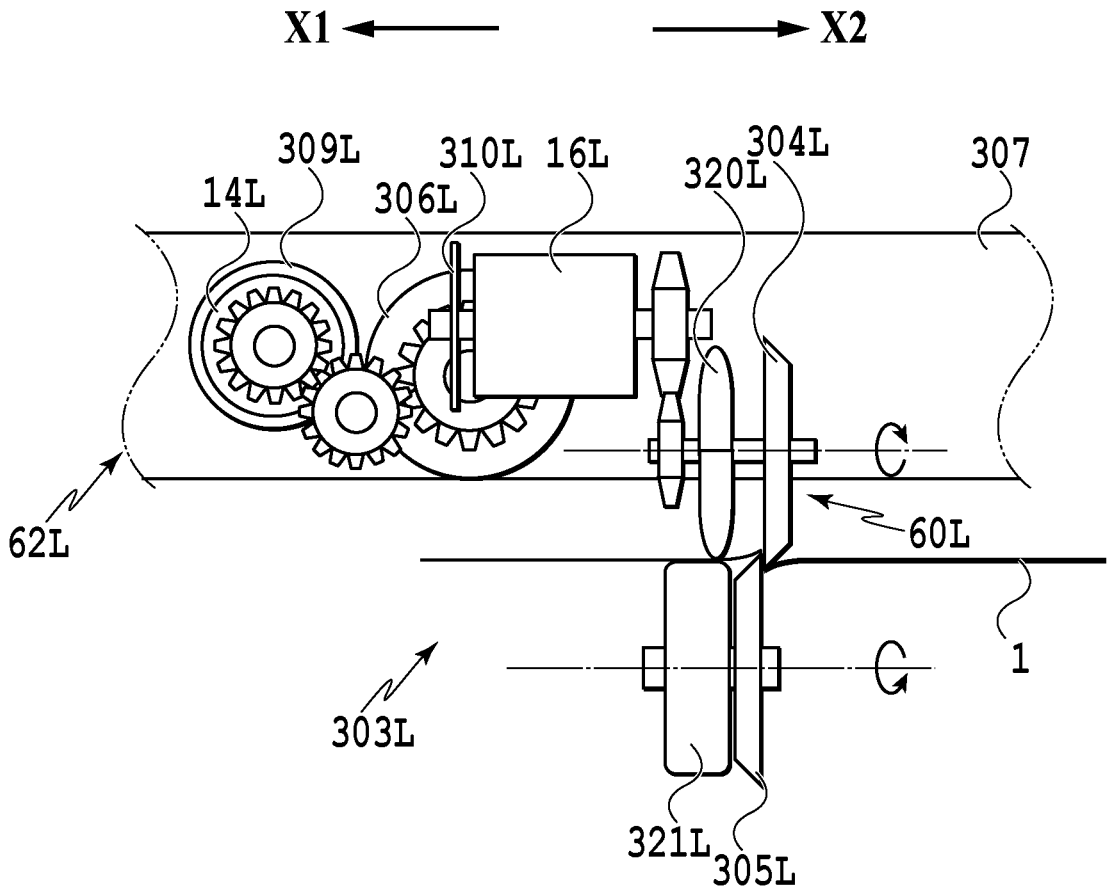
FIG. 6 is a diagram for explaining a configuration of the slitter unit.

FIG. 5A, FIG. 5B, and FIG. 6 are diagrams for explaining details of the slitter unit 303L. FIG. 5A is a plan view of the cutting part 60L of the slitter unit 303L, and FIG. 5B is a side view of the cutting part 60L. FIG. 6 is a front view of the slitter unit 303L.

The slitter unit 303L is equipped with the cutting part 60L, which cuts the print medium 1 along the Y direction, and the moving part 62L, which moves the cutting part 60L along the X direction (see FIG. 4). In the present embodiment, the slitter unit 303 functions as a cutting unit that cuts the print medium 1 along the conveyance direction.

The cutting part 60L is equipped with the slitter upper movable blade 304L and the slitter lower movable blade 305L. The slitter upper movable blade 304L and the slitter lower movable blade 305L are respectively arranged so as to have the round-blade overlap amount 313L in the up-down direction (the Z direction) (see FIG. 5A and FIG. 5B) and have a predetermined amount of angle (the intersect angle) 0 relative to the conveyance direction, which is the cutting direction (see FIG. 5A).

The print medium 1 is cut at the contact point 311L (see FIG. 5B) between the slitter upper movable blade 304L and the slitter lower movable blade 305L. The slitter upper movable blade 304L is connected to the slitter driving motor 16L via gears (see FIG. 6) and is rotated by driving of the slitter driving motor 16L. In a case where the slitter upper movable blade 304L is rotated by a driving force of the slitter driving motor 16L, the slitter upper conveyance roller 320L, which is connected coaxially with the slitter upper movable blade 304, rotates as well. The outer peripheral surface of the slitter upper conveyance roller 320L is in contact with the outer peripheral surface of the slitter lower conveyance roller 321L, which is connected coaxially with the slitter lower movable blade 305L, at the roller nip point 312L (see FIG. 5B).

Therefore, the slitter lower conveyance roller 321L is driven by friction transmission of the slitter upper conveyance roller 320L, and the slitter lower movable blade 305L rotates with driving of this slitter lower conveyance roller 321L. Therefore, with driving by such friction transmission as described above, the print medium 1 is conveyed by the slitter upper conveyance roller 320L and the slitter lower conveyance roller 321L, and the print medium 1 is cut in the conveyance direction while the upper and lower blades (304L, 305L) rotate together.

The slitter driving motor 16L is equipped with the slitter driving encoder 310L, and the driving amount thereof can be controlled based on an output result of this slitter driving encoder 310L. The driving of the slitter driving motor 16L is controlled in synchronization with the conveyance roller 8. As will be described in detail later, in the present embodiment, the driving amount of the conveyance roller 8 and the driving amount of the slitter driving motor 16L can be controlled by the control part 410.

Further, the moving part 62L is equipped with the slitter moving motor 14L and the slitter moving roller 306L. The slitter moving motor 14L is configured to be capable of transmitting a driving force to the slitter moving roller 306L via a gear. Note that the slitter moving motor 14L is equipped with the slitter moving encoder 309L, and the driving amount thereof is controlled by the control part 410, based on an output result of this slitter moving encoder 309L. That is, the movement position of the slitter unit 303L from the stand-by position is controlled based on an output result of the slitter moving encoder 309L.

The slitter moving roller 306L is disposed so as to be movable along the slitter guide rail 307 extending in the X direction. Specifically, the slitter moving roller 306L abuts on the slitter guide rail 307. Furthermore, if the slitter moving roller 306L is driven, the slitter unit 303L moves in the X1 and X2 directions by friction between the surface of the slitter moving roller 306L and the slitter guide rail 307. That is, the slitter upper movable blade 304L, the slitter lower movable blade 305L, the slitter upper conveyance roller 320L, and the slitter lower conveyance roller 321L are integrally movable along the slitter guide rail 307.

Although the movement mechanism of the moving part 62L is driving with friction of the slitter moving roller 306L in the present embodiment, it is also possible to have a rack and pinion configuration with the slitter moving roller 306 serving as a pinion and a slitter guide rail serving as a rack.

In a case where the print medium 1 is cut by the slitter unit 303 having such a configuration as described above, firstly, the slitter units 303L and 303R are moved to the cutting positions. Further, the conveyance motor 51 that drives the conveyance roller 8 and the slitter driving motors 16L and 16R are driven, so that the print medium 1 is conveyed by the conveyance roller 8.

Next, if the leading edge of the print medium 1 conveyed by the conveyance roller 8 reaches the contact points 311L and 311R of the slitter 13, the print medium 1 is conveyed by the slitter upper conveyance rollers 320L and 320R and the slitter lower conveyance rollers 321L and 321R. Further, here, the print medium 1 is cut by the left and right slitter upper movable blades 304L and 304R and the slitter lower movable blades 305L and 305R. In this way, the print medium 1 is nipped and conveyed by the upper and lower rollers (320, 321) while being cut by the upper and lower blades (304, 305) and is discharged through the discharge guide 11.

The cutting by the slitter unit 303 can be executed in parallel with the printing operation. The slitter units 303 moves from the stand-by positions to predetermined cutting positions in the X1 and X2 directions according to the setting by the user. Further, the conveyance motor 51 and the slitter driving motor 16 are driven, so that the print medium 1 is conveyed by the conveyance roller 8.

In the image printing part, if an image is printed by scanning of one line with movement of the print head 2 in the X1 or X2 direction via the carriage 3, the print medium 1 is conveyed by a predetermined amount by the conveyance roller 8 and the pinch roller 9. Then, scanning is performed with the print head 2 via the carriage 3, so that an image is printed. If the printing proceeds and the leading edge of the print medium 1 reaches the contact points 311, the print medium 1 is cut by the slitter upper movable blades 304L and 304R and the slitter lower movable blades 305L and 305R that are rotating. Furthermore, the print medium 1 is nipped and conveyed by the slitter upper conveyance rollers 320L and 320R and the slitter lower conveyance rollers 321L and 321R while being cut.

Then, if the printing of the image is ended and the cutting by the slitter units 303 is ended, the slitter units 303 move to the predetermined stand-by positions, which are located in the vicinity of the first end portion 1*a* of the print medium and the second end portion 1*b* of the print medium, for example. Thereafter, the print medium 1 is conveyed to a cutting position, at which the cutting by the cutter unit 300 can be performed, and cut in the X direction by the cutter unit 300, and then the cut section is discharged through the discharge guide 11.

Note that the configuration of the slitter 13 described above is merely an example. That is, the slitter 13 may have any configuration as long as the slitter 13 is movable in the width direction of the print medium 1 and is capable of cutting the conveyed print medium 1 in the conveyance direction at a given position of the width direction. For example, there may be a form in which the slitter upper conveyance rollers 320 and the slitter lower conveyance rollers 321 and the slitter upper movable blades 304 and the slitter lower movable blades 305 are separately driven. Further, it is also possible that a driving source is not included and the movement to the cutting position is manually performed and that the cutting part 60 is configured with a fixed flat blade.

<Control Configuration of the Printing Apparatus>

Figure 7:
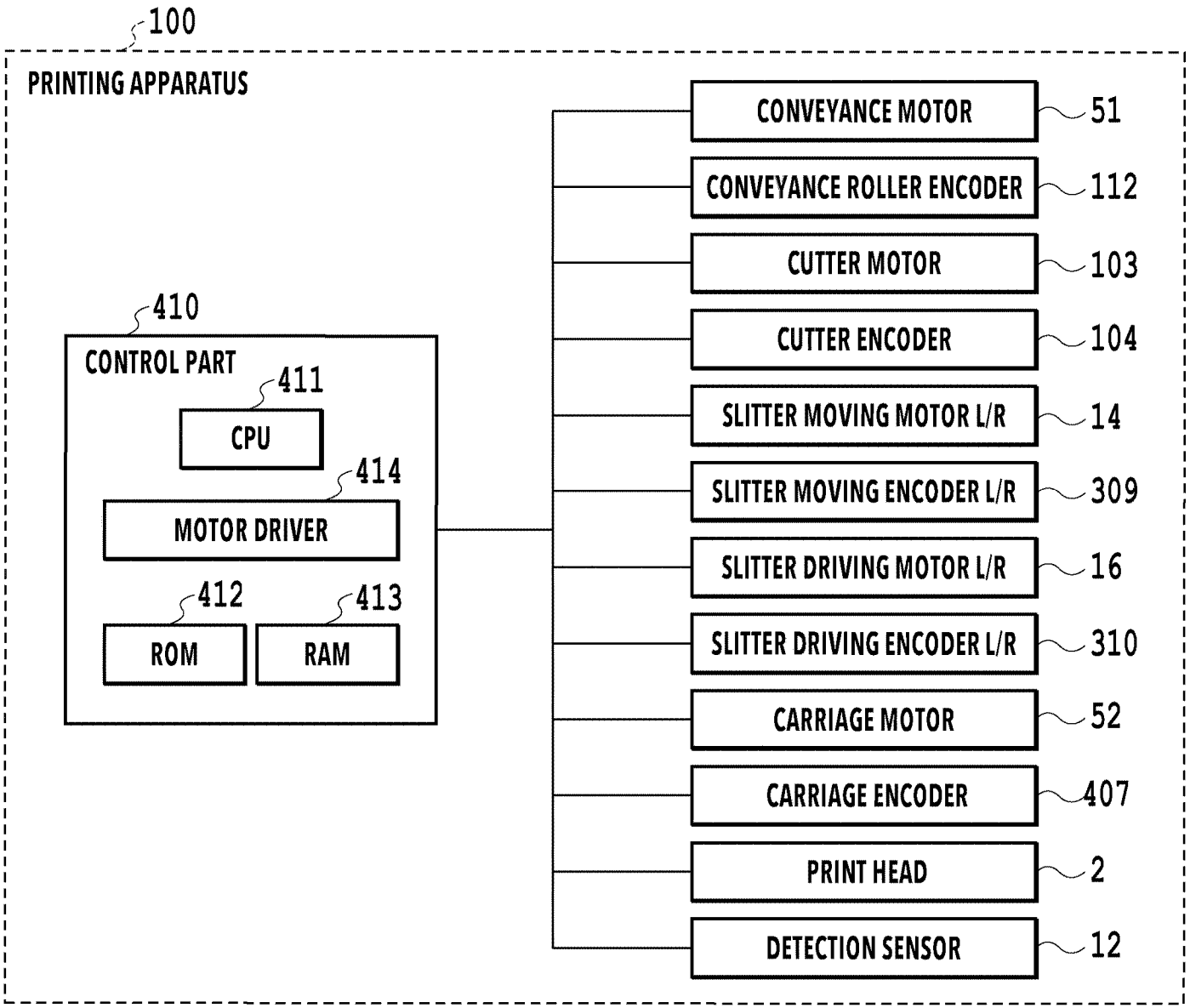
FIG. 7 is a block configuration diagram of a control system of the printing apparatus.

FIG. 7 is a block configuration diagram of a control system of the printing apparatus 100. The printing apparatus 100 is equipped with the control part 410 for controlling the overall operation of the apparatus. The control part 410 is equipped with the CPU 411, the ROM 412, the RAM 413, and the motor driver 414. Note that, although an illustration in the drawing is omitted, the control part 410 is also equipped with the ASIC 603 that controls the detection sensor 12.

The control part 410 controls the conveyance motor 51 that drives the conveyance roller 8, the cutter motor 103 that drives the cutter 5, the slitter moving motor 14 that moves the slitter 13, and the slitter driving motor 16 that drives the cutting part 60 of the slitter 13. Further, the control part 410 controls the carriage motor 52 that moves the carriage 3, the conveyance roller encoder 112 that detects the driving amount of the conveyance motor 51, and the cutter encoder 104 that detects the driving amount of the cutter motor 103. Further, the control part 410 controls the slitter moving encoder 309 that detects the driving amount of the slitter moving motor 14 and the slitter driving encoder 310 that detects the driving amount of the slitter driving motor 16. Furthermore, the control part 410 controls driving of the carriage encoder 407 for detecting the position of the carriage 3, the print head 2 that applies ink to the print medium 1, and the detection sensor 12. That is, the control part 410 controls each motor and the print head 2, based on signals obtained from each encoder, sensor, etc.

<Print Processing>

As described above, the printing apparatus 100 has a configuration in which a predetermined position in the width direction (the X direction) of the print medium 1 on which an image is printed can be cut by the slitter 13. Therefore, in the printing apparatus 100, what is termed as a marginless printing can be performed by cutting the inside of both X-direction end portions of an image print area, in which an image to be left as a product is printed, with the slitter 13 with respect to the width direction, for example. Compared with a case in which marginless printing is performed by a printing apparatus that is not equipped with the slitter 13, it is possible for the printing apparatus 100 to greatly suppress ink adherence to the platen 10 since it is not necessary to apply ink so that the ink protrudes from the print medium 1.

Therefore, in the printing apparatus 100, it is possible to select either "with-margin" or "marginless" as a margin setting via an operation part (not illustrated in the drawings) disposed in the printing apparatus 100, a host apparatus (not illustrated in the drawings) connected to the printing apparatus 100, or the like. In a case where the margin setting is "marginless", the slitter 13 performs cutting on the image to be left as a product as described above. On the other hand, in a case where the margin setting is "with-margin", the outside of the image to be left as a product, i.e., the unprinted section in the X direction, is cut by the slitter 13.

Figure 8B:
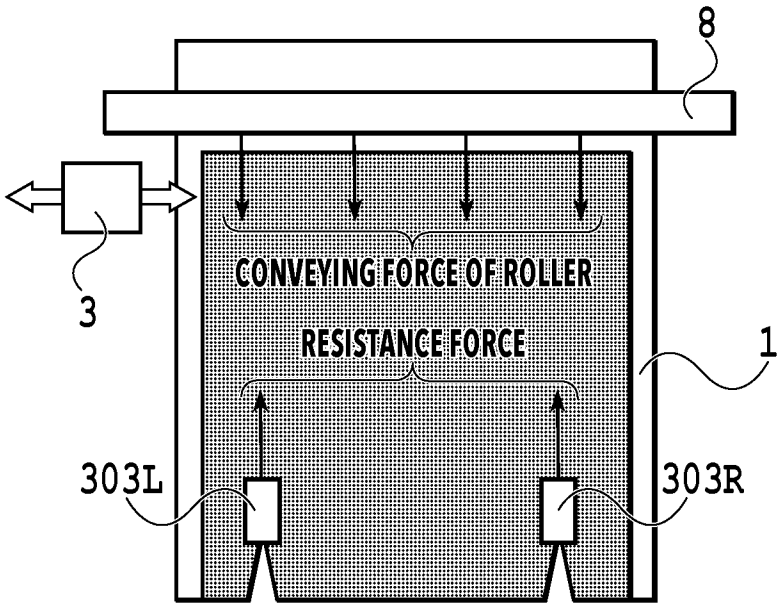
FIG. 8A and FIG. 8B are diagrams for explaining a resistance force generated to the slitter unit.
Figure 8A:
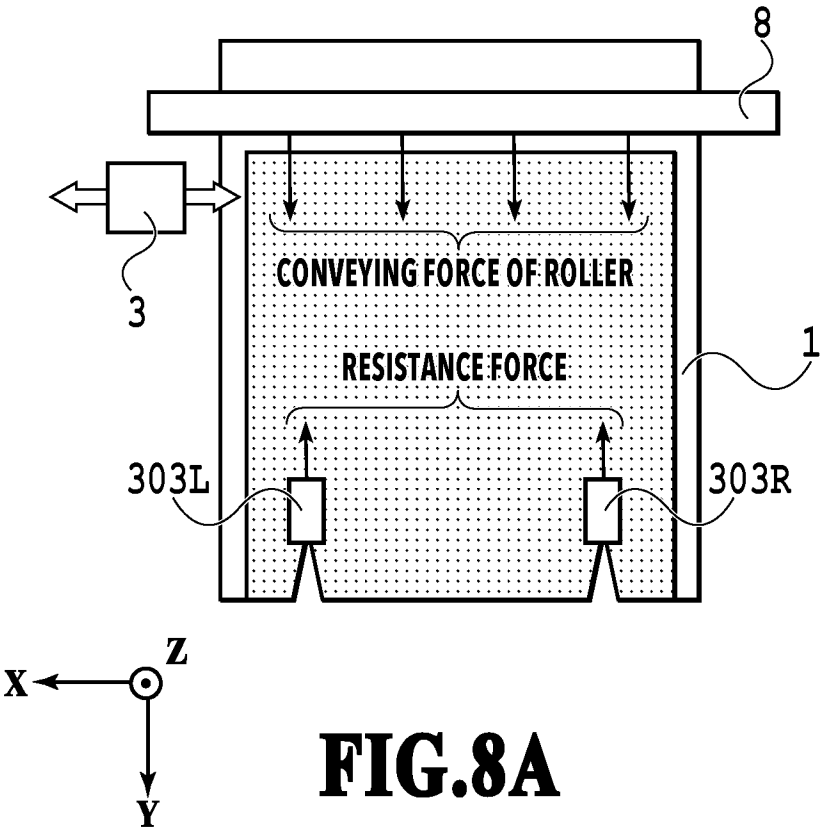

FIG. 8A and FIG. 8B are diagrams for explaining a resistance force generated to the cutting part 60 of the slitter unit 303 according to an application amount of ink at the time of executing marginless printing. FIG. 8A is a diagram illustrating a case in which the application amount of ink in the image print area is small, and FIG. 8B is a diagram illustrating a case in which the application amount of ink in the image print area is large. When the cutting is performed by the slitter 13, a resistance force is generated to the cutting part 60 in the −Y direction in response to a conveying force of the print medium 1 in the +Y direction. In a case of performing marginless printing in which the inside of an image print area is cut by the slitter 13, when the application amount of ink in the image print area is large (see FIG. 8B), the above-described resistance force becomes larger than when the application amount of ink in the image print area is small (see FIG. 8A). This is because the rigidity (stiffness) of the print medium 1 decreases as the application amount of ink increases.

Therefore, due to this difference of a resistance force, the conveyance amount by the slitter upper conveyance roller 320 of the slitter unit 303 decreases as the application amount of ink in the image print area increases. That is, if the application amount of ink in the image print area increases, the resistance force applied to the cutting part 60 will increase, and, as a result, the conveyance amount by the slitter upper conveyance roller 320 will decrease.

By the way, the resistance force generated to the cutting part 60 of the slitter unit 303 changes depending on the type of the print medium 1, the setting in the printing mode, the external environment, the cutting amount by the cutting part 60, etc., as well as the application amount of ink in the image print area. The thickness, rigidity, basis weight, etc., of the print medium 1 are different depending on the type of the print medium 1. The setting in the printing mode is, for example, the conveyance amount of the print medium conveyed after one scanning. The external environment is the temperature and humidity of the place where the printing apparatus is installed. The cutting amount by the cutting part 60 is the number of cuttings by the cutting part 60, the actual cut length, etc. In this way, the conveyance amount of the conveyance roller 8 and the conveyance amount of the slitter upper conveyance roller 320 when the slitter unit 303 cuts the print medium change depending on the various conditions described above.

Therefore, due to changes in the conveyance amounts of the conveyance roller 8 and the slitter upper conveyance roller 320, floating or bending of the print medium 1 may occur between these two conveyance rollers. Accordingly, the cutting accuracy of the slitter unit 303 is deteriorated. Further, in the present embodiment, the print head is located between the above-described two conveyance rollers, and, if floating or bending occurs to the print medium 1, landing positions of ink will be shifted, which will cause the printed image to have density unevenness or streaks. Note that, in the present embodiment, the conveyance roller 8 functions as the first conveyance unit that conveys the print medium 1 in the conveyance direction, and the slitter upper conveyance roller 320 functions as the second conveyance unit that conveys the print medium 1 which is conveyed by the conveyance roller 8 in the conveyance direction. Accordingly, in the present embodiment, the conveyance motor 51 functions as the first driving unit that drives the conveyance roller 8, and the slitter driving motor 16 functions as the second driving unit that drives the slitter upper conveyance roller 320.

Therefore, in the present embodiment, a pattern for obtaining a shift in a conveyance amount is printed for each unit print area (band), which is printed by multiple times of scanning (passes). Then, based on the detection result of detection by reading the printed pattern, the driving amounts of the conveyance motor 51 and the slitter driving motor 16 are corrected (adjusted) so that the tension of the print medium 1 between the conveyance roller 8 and the slitter upper conveyance roller 320 is within a predetermined range.

That is, in the present embodiment, the driving amounts (the rotation speeds, the rotation amounts) of the conveyance motor 51 and the slitter driving motor 16 are corrected as parameters related to the conveyance by the conveyance roller 8 and the slitter upper conveyance roller 320. Here, the driving amount of the conveyance motor 51 corresponds to the rotation speed or the rotation amount of the conveyance roller 8, and the driving amount of the slitter driving motor 16 corresponds to the rotation speed or the rotation amount of the slitter upper conveyance roller 320. Therefore, by correcting the driving amounts of the conveyance motor 51 and the slitter driving motor 16, the conveyance speed or conveyance amount (the conveyance distance) of the print medium 1 with the two conveyance rollers is corrected.

Note that, if the tension generated to the print medium 1 between the two conveyance rollers is set higher than necessary, the conveyance accuracy of the print medium 1 may be deteriorated. Therefore, the above-described predetermined range is, for example, such a range in which the cutting accuracy of the slitter 13 can be preferably maintained and the conveyance accuracy is not deteriorated. That is, in the present embodiment, the shift in the conveyance amount of the two conveyance rollers, which is detected based on the reading result of the above-described pattern, is obtained as the information related to the change in the rigidity of the print medium, so that the driving amounts of the two conveyance rollers are corrected based on the information.

Hereinafter, the print processing executed by the printing apparatus 100 will be explained in detail. Note that, in the present embodiment, the printing apparatus 100 employs a multi-pass printing system in which a unit print area (band) that can be printed by one scanning of the print head 2 is printed by multiple times of scanning (passes). In the present embodiment, the case in which one band is printed by two passes will be explained.

Figure 9:
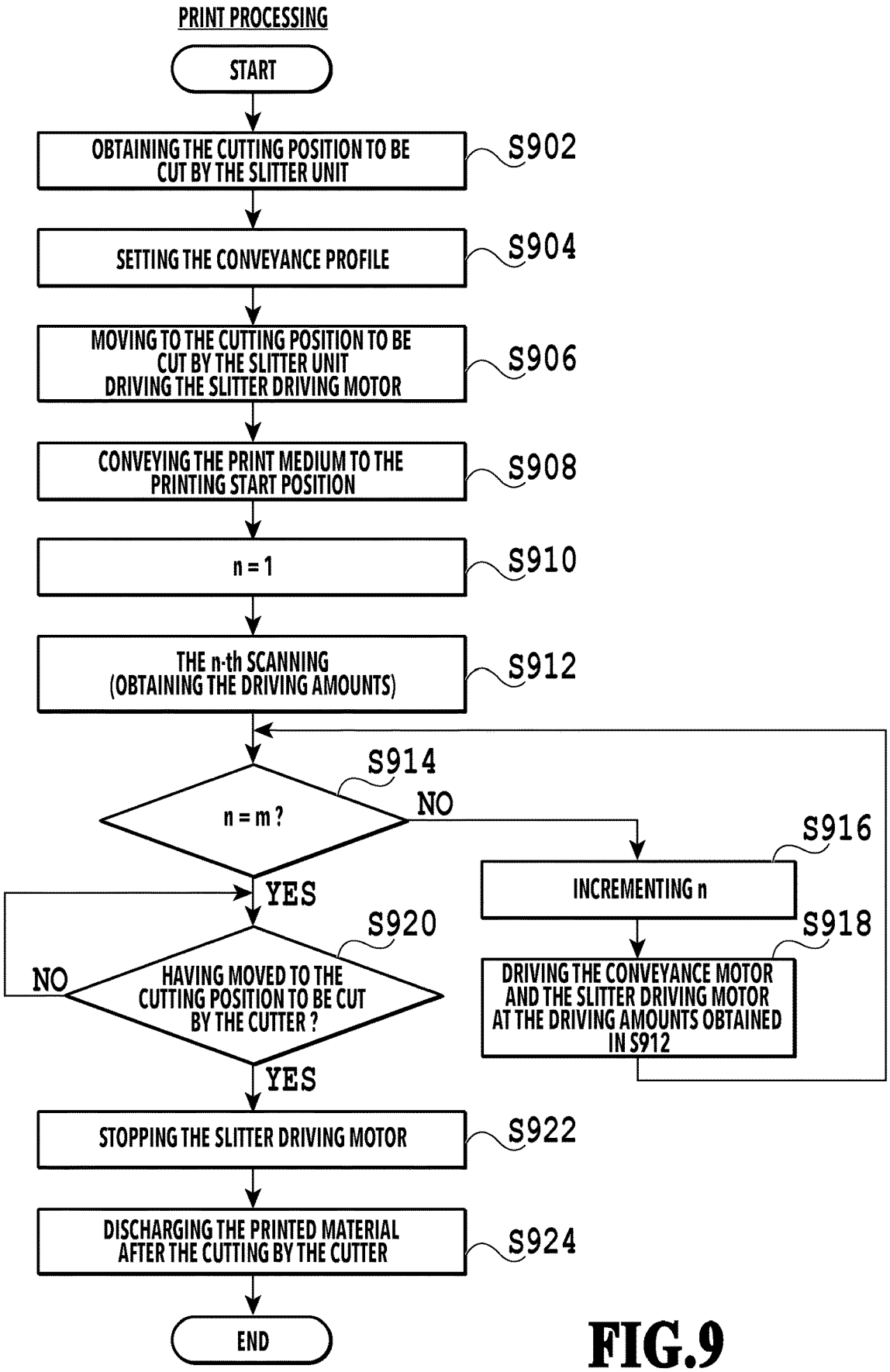
FIG. 9 is a flowchart of print processing to be executed by the printing apparatus according to the first embodiment.
Figure 10A:
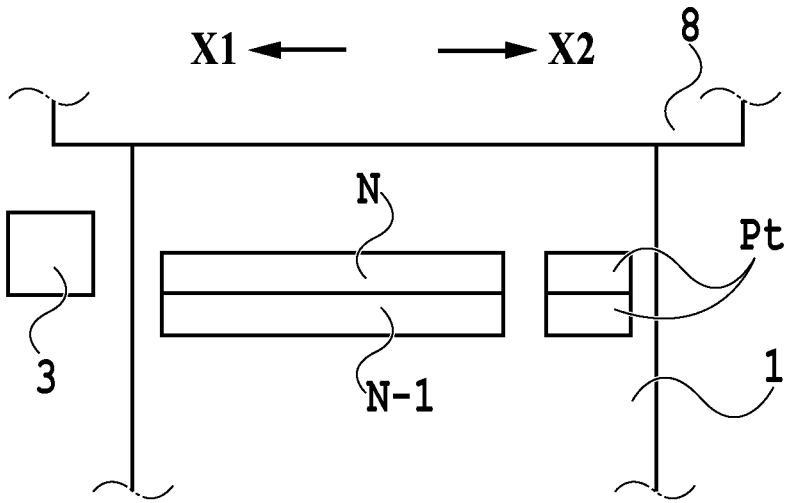
FIG. 10A and FIG. 10B are diagrams for explaining a printing method of a detection pattern.
Figure 10B:
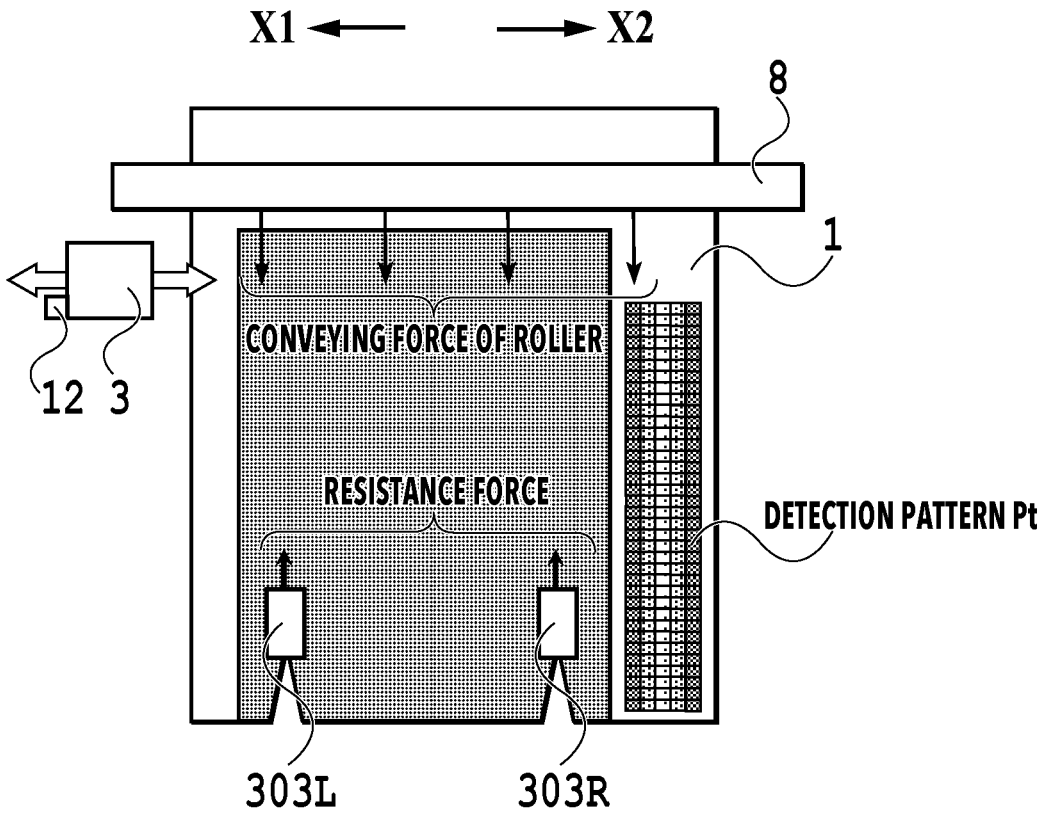

FIG. 9 is a flowchart illustrating details of the print processing to be executed in the printing apparatus 100. FIG. 10A is a diagram for explaining printing during scanning, and FIG. 10B is a diagram illustrating a state in which printing has been performed with multiple scan counts. The series of the processes illustrated in the flowchart of FIG. 9 is performed by the CPU 411 (ASIC 603) loading a program code stored in the ROM 412 into the RAM 413 and executing the program code. Alternatively, a part or all of the functions in the steps of FIG. 9 may be executed by hardware such as an ASIC or an electronic circuit. Note that the reference sign "S" in the explanation of each process means that it is a step of the flowchart.

If the print processing is started, the CPU 411 firstly obtains the cutting position to be cut by the slitter unit 303 on the print medium 1 (S902). For example, the cutting position of the print medium 1 to be cut by the slitter unit 303 is included in the job data and is input from a host apparatus or the like. Note that the input of the cutting position is not limited as such, and, for example, there may be a form in which the input is provided by the user from an operation part (not illustrated in the drawings) or the like disposed in the printing apparatus 100.

If the cutting position to be cut by the slitter unit 303 is obtained, the CPU 411 subsequently sets the conveyance profile (S904). The conveyance profile is stored in advance. As the conveyance profile in the area where the conveyance is performed at a predetermined pitch, the conveyance distance, conveyance speed, and conveyance acceleration and deceleration speeds are set. Note that the conveyance speed is the conveyance speeds of the conveyance roller 8 and the slitter upper conveyance roller 320.

Next, the CPU 411 moves the slitter units 303L and 303R, based on the cutting position obtained in S902, and drives the slitter driving motor 16 at the conveyance speed (S906). That is, in S906, the slitter driving motor 16 is driven so that the conveyance speed of the slitter upper conveyance roller 320 becomes the conveyance speed which is set as the conveyance profile. Thereafter, the CPU 411 drives the conveyance roller 8 to convey the print medium 1 to the printing start position (S908) and sets the variable "n" representing the scan counts to "1" (S910). In the conveyance of S908, the conveyance speed of the conveyance roller 8 is the conveyance speed which is set as the conveyance profile.

Then, the CPU 411 performs the n-th scanning (S912). That is, in S912, the CPU 411 makes the print head 2 eject ink while moving the print head 2 in the X direction, so that the ink is applied to the unit print area N of the print medium 1 at the position facing the print head 2 (see FIG. 10A). Here, the detection pattern Pt, with which the shift in the conveyance amount between the two conveyance rollers from the set conveyance amount can be detected, is printed on the outside of the unit print area N in the X direction, i.e., in the margin area of the print medium 1 in which the image based on the image data is not printed. Note that the two conveyance rollers are the conveyance roller 8 and the slitter upper conveyance roller 320. Details of this detection pattern Pt will be described later. Although it is assumed that the area where the detection pattern Pt is printed is on one side (the right side in the drawing) of the unit print area N in the present embodiment, there is not a limitation as such, and the other side (the left side in the drawing) is also possible as long as there is a margin area where the detection pattern Pt can be printed.

Further, in S912, with the detection sensor 12, the CPU 411 reads the detection pattern Pt formed outside the unit print area N−1, which is adjacent to the downstream side of the unit print area N. Note that, as for the first unit print area, there is no unit print area on the downstream side. Therefore, in this case, for example, it is also possible to ignore the detection result from the detection sensor 12. Then, based on the information read by the detection sensor 12, the CPU 411 detects the shift in the conveyance amount between the two conveyance rollers and obtains the corrected driving amounts for the conveyance motor 51 and the slitter driving motor 16. Note that the method of obtaining the corrected driving amounts of the conveyance motor 51 and the slitter driving motor 16 from the information read by the detection sensor 12 will be described later.

In the present embodiment, since the detection sensor 12 is disposed on the downstream side relative to the nozzle rows 20 in the print head 2, the unit print area N−1 which is located on the downstream side of the unit print area N is read by the detection sensor 12 at the time of printing the unit print area N. In FIG. 10B, an example in which the arrangement position of the detection sensor 12 on the carriage 3 is different is illustrated. Specifically, the detection sensor 12 is disposed on the carriage 3 so as to overlap the nozzle rows 20 of the print head 2 in the Y direction and be shifted in the X1 direction. In this case, if printing is performed when the print head 2 performs scanning in the X2 direction, the detection pattern Pt immediately after the printing by the print head 2 can be read.

After performing the n-th scanning, the CPU 411 then determines whether or not "n" is the last scan count "m" for the printing based on the image data (S914). Note that this "m" is obtained based on the image data, for example. If it is determined in S914 that n is equal to m, "n" is incremented (S916), and the conveyance motor 51 and the slitter driving motor 16 are driven by the obtained driving amounts (S918). In S918, the conveyance motor 51 and the slitter driving motor 16 are driven by the corrected driving amounts, which are obtained in S912, not by the driving amounts based on the conveyance speeds of the conveyance profile, so that the print medium 1 is conveyed by a predetermined amount. Note that it is also possible that the driving amounts obtained in S912 are resultantly the same as the driving amounts based on the conveyance speeds which are set as the conveyance profile.

In the present embodiment, since a unit print area is printed with two passes, if the length of the nozzle rows 20 in the Y direction is L, the predetermined amount is L/2. Thereafter, the processing returns to S912. As described above, in the present embodiment, the control part 410 which is equipped with the CPU 411 functions as a correction unit that corrects the driving amounts of the conveyance roller 8 and the slitter upper conveyance roller 320.

Further, if it is determined in S914 that n is equal to m, the CPU 411 conveys the print medium 1 and determines whether or not the print medium 1 has moved to the position where the print medium 1 is cut by the cutter 5 (S920). In S920, for example, the determination is made based on the conveyance amount of the print medium 1 after the end of the printing. Note that, since subsequent detection patterns cannot be read if the printing is ended, the driving amounts of the conveyance motor 51 and the slitter driving motor 16 in the conveyance of S920 are set based on the conveyance speeds which are set as the conveyance profile. Alternatively, it is also possible that the latest driving amounts are maintained.

If it is determined in S920 that the print medium 1 has moved to the position where the print medium 1 is cut by the cutter 5, the CPU 411 stops the slitter driving motor 16 and the conveyance motor 51 (S922). Thereafter, the cutter motor 103 is driven so that the cutter 5 cuts the print medium 1 in the X direction, then the printed material (product) is discharged (S924), and then this print processing is ended.

Next, the detection pattern Pt will be explained. As described above, the detection pattern Pt is printed outside the unit print area, that is, in the margin area of the print medium 1. That is, as in FIG. 10B, while the printing is performed in the unit print area by scanning with the print head 2, the detection pattern Pt is also printed outside the unit print area. Then, the optical characteristic of the detection pattern Pt printed outside the latest unit print area is read by the detection sensor 12.

The detection pattern Pt is printed as a pattern or in a printing method, according to which the lightness changes in response to a change in the conveyance amount of the conveyance roller 8 and the slitter upper conveyance roller 320. Further, based on this fluctuation of lightness of the detection pattern Pt, the amount of shift in the conveyance amount between the two conveyance rollers relative to the set conveyance amount will be obtained.

Figure 11A:
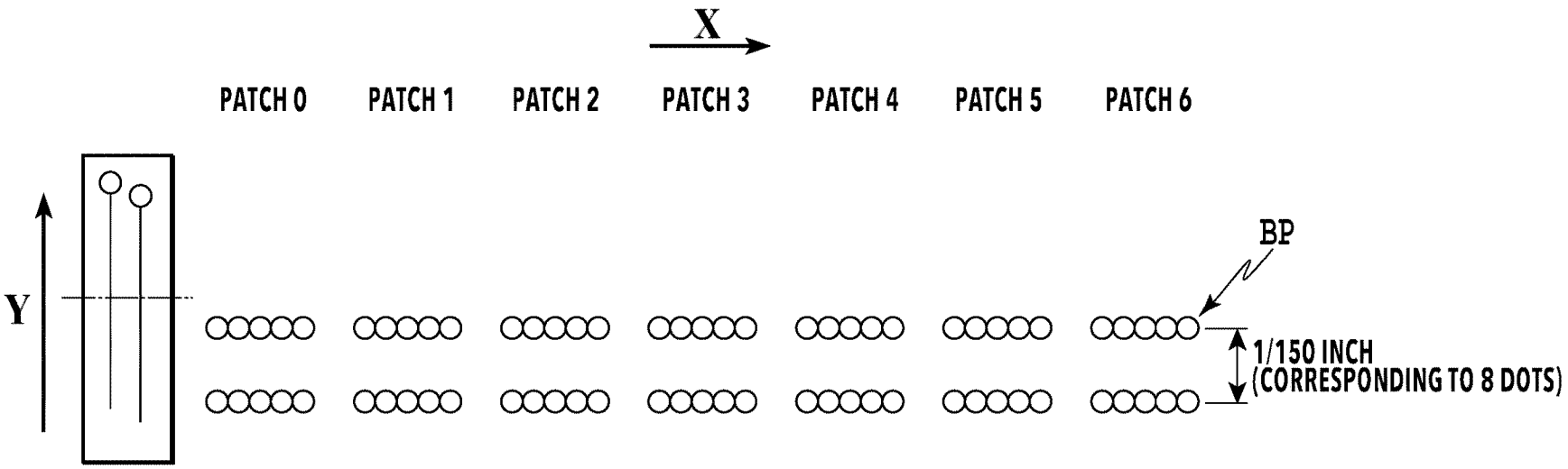
FIG. 11A and FIG. 11B are diagrams for explaining the detection pattern.
Figure 11B:
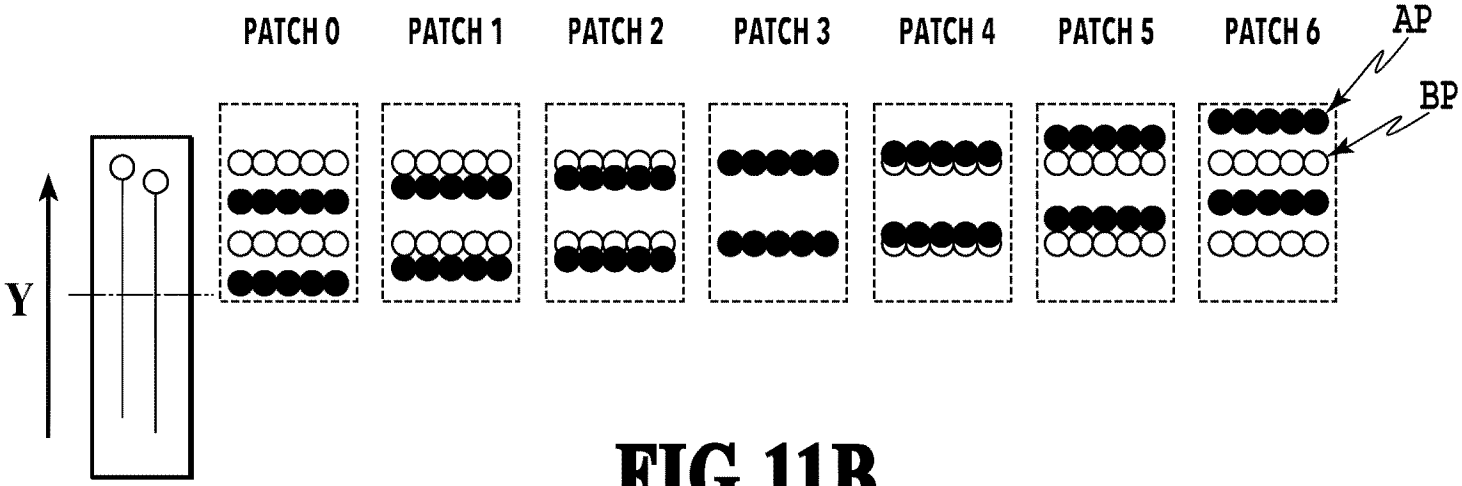

FIG. 11A and FIG. 11B are diagrams for explaining an example of the detection pattern Pt. FIG. 11A is a diagram illustrating a state in which only a reference pattern in the detection pattern Pt is printed. FIG. 11B is a diagram illustrating a state in which an adjustment pattern is printed on a reference pattern as the detection pattern Pt.

For the detection pattern Pt, firstly, the reference pattern BP is printed with a predetermined ink in the first pass. The reference pattern BP is printed by utilizing two predetermined nozzles located on the upstream side of the conveyance direction (hereinafter also simply referred to as "on the upstream side") of the nozzle row 20 in the print head 2 for ejecting the predetermined ink. These two nozzles are spaced by four nozzle intervals in the ODD row, for example. Further, by ejecting ink from these two nozzles, seven lines extending in the X direction are printed along the X direction. Each line has the same length as each other and is formed so as to have a predetermined interval with an adjacent line. Accordingly, as in FIG. 11A, the reference pattern BP, in which the seven lines formed along the X direction are formed at two positions that are separated by 1/150 inch (corresponding to 8 dots) in the Y direction, is formed. Note that the lines separated in the Y direction are formed at positions that approximately match each other in the X direction.

Next, the print medium 1 is conveyed by an amount corresponding to half the distance of the nozzle row 20. Thereafter, in the second pass, the adjustment pattern AP is printed with the above-described predetermined ink at positions that approximately match the reference pattern BP in the X direction. The adjustment pattern AP is printed by corresponding nozzles that correspond to the two predetermined two nozzles with which the reference pattern BP is printed. Note that, in the present embodiment, the corresponding nozzles are a total of seven nozzles, respectively, including a reference nozzle, which is a nozzle in an ODD row that is present at a position separated by 320 nozzles to the downstream side in the conveyance direction from each of the predetermined two nozzles, and the three nozzles on the upstream side of the reference nozzle and the three nozzles on the downstream side of the reference nozzle. Note that, as the corresponding nozzles, nozzles of both ODD rows and EVEN rows are used. In the following explanation, the downstream side of the conveyance direction is also simply referred to as the "downstream side".

Further, the adjustment pattern AP is printed from one side (the left side in the drawing) in the X direction toward the other side so as to be shifted by one nozzle in the Y direction. That is, from the one side (the left side in the drawing) of the reference pattern BP toward the other side, the printing is performed with the nozzle that is three nozzles away to the upstream side from the reference nozzle, the nozzle that is two nozzles away to the upstream side from the reference nozzle, the nozzle that is one nozzle away to the upstream side from the reference nozzle, the reference nozzle, the nozzle that is one nozzle away to the downstream side from the reference nozzle, the nozzle that is two nozzles away to the downstream side from the reference nozzle, and the nozzle that is three nozzles away to the downstream side from the reference nozzle. The lines printed by the respective nozzles in the adjustment pattern AP extend in the X direction, have the same length as each other, and are formed at predetermined intervals in the X direction from the adjacent lines.

Accordingly, in a case where there is no change in the conveyance amount of the conveyance roller 8 and the slitter upper conveyance roller 320, the detection pattern Pt as illustrated in FIG. 11B will be formed. In this detection pattern Pt, at the position of PATCH 3, the line formed by the reference nozzle (ODD row) as the adjustment pattern AP approximately matches and overlaps the reference pattern BP. Note that, in FIG. 11B, at the position of PATCH 0, the line formed as the adjustment pattern AP by the nozzle (EVEN row) that is three nozzles away to the upstream side from the reference pattern BP is printed at the position that is shifted from the reference pattern BP to the upstream side by three dots (−3). Further, at the position of PATCH 1, the line formed as the adjustment pattern AP by the nozzle (ODD row) that is two nozzles away to the upstream side from the reference pattern BP is printed at the position that is shifted from the reference pattern BP to the upstream side by two dots (−2). Further, at the position of PATCH 2, the line formed as the adjustment pattern AP by the nozzle (EVEN row) that is one nozzle away to the upstream side from the reference pattern BP is printed at the position that is shifted from the reference pattern BP to the upstream side by one dot (−1). Further, at the position of PATCH 4, the line formed as the adjustment pattern AP by the nozzle (EVEN row) that is one nozzle away to the downstream side from the reference pattern BP is printed at the position that is shifted from the reference pattern BP to the downstream side by one dot (+1). Further, at the position of PATCH 5, the line formed as the adjustment pattern AP by the nozzle (ODD row) that is two nozzles away to the downstream side from the reference pattern BP is printed at the position that is shifted from the reference pattern BP to the downstream side by two dots (+2). Further, at the position of PATCH 6, the line formed as the adjustment pattern AP by the nozzle (EVEN row) that is three nozzles away to the downstream side from the reference pattern BP is printed at the position that is shifted from the reference pattern BP to the downstream side by three dots (+3).

When the detection pattern Pt described above is read by the detection sensor 12, the area factor, i.e., a value corresponding to the density, of the area (the broken line in the drawing) of PATCH 3 has the lowest value. The area factor herein is theoretically about 12.5% (=100/8). However, due to various factors such as the type of print medium and the conveyance accuracy of the machine, there is a case in which the conveyance amount of the print medium corresponding to a command pulse value differs from the theoretical value in the conveyance mechanism. In this case, in PATCH 3, the adjustment pattern AP (the black circles in the drawing) is shifted from the reference pattern BP (the white circles in the drawing), so that the area factor will be a numerical value exceeding 12.5%.

Here, in PATCH 0 and PATCH 6 of FIG. 11B, there is a shift corresponding to pixels of seven dots between the lines formed as the adjustment pattern. Therefore, in a case where a shift within pixels of seven dots occurs due to a change in the conveyance amount of the conveyance roller 8 or the slitter upper conveyance roller 320, one of the seven patches will have an area factor of about 12.5%. Since the area factor and the density can be associated with each other on a one-to-one basis, it is possible to find the shift amount of the conveyance amount by detecting the patch position of which the density is the lowest with the detection sensor 12.

Figure 12:
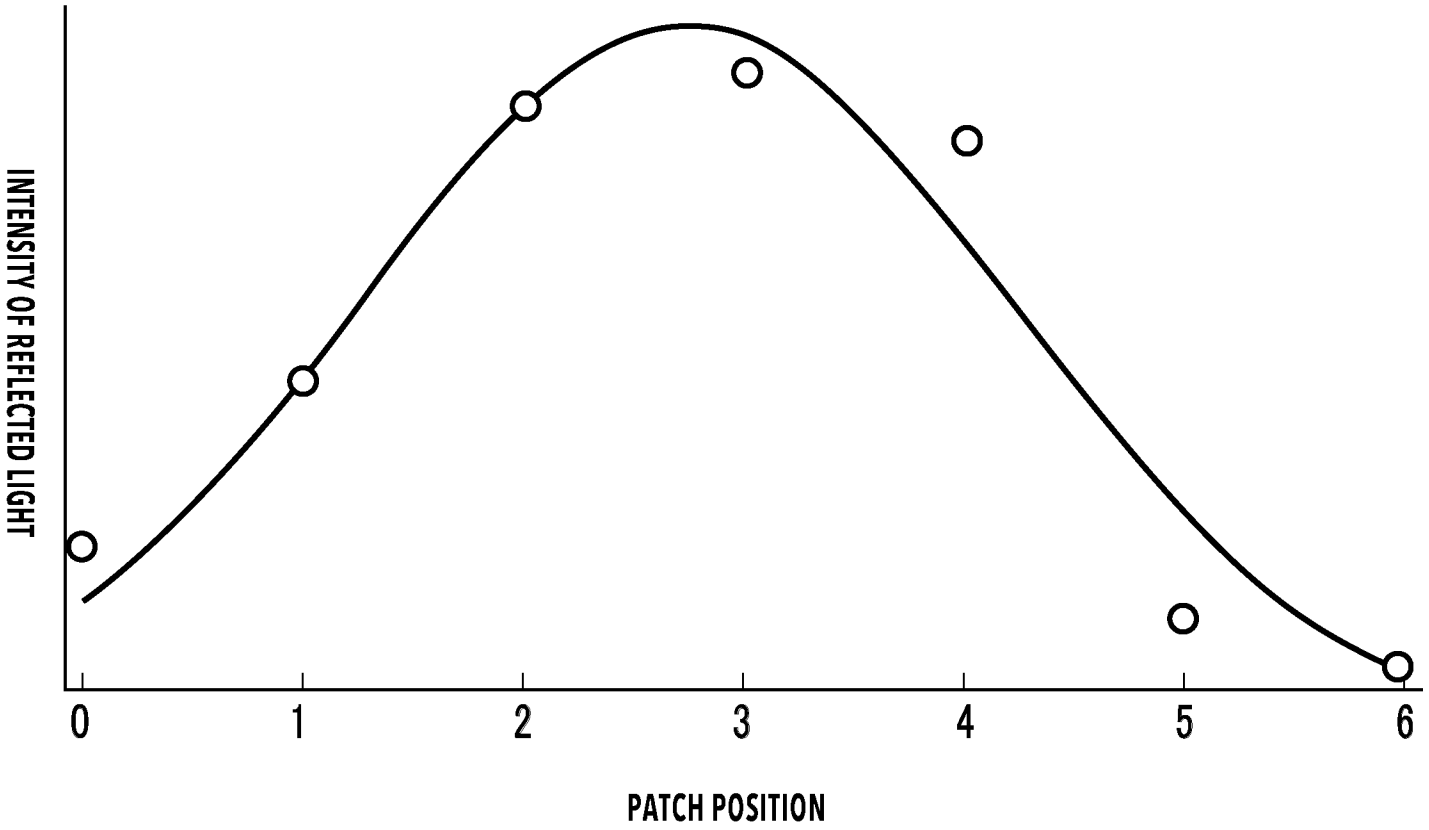
FIG. 12 is a diagram illustrating intensity of reflected light in each patch of the detection pattern.

Next, the detection of the detection pattern Pt by the detection sensor 12 will be explained. FIG. 12 is a diagram illustrating a detection example of the detection pattern Pt of FIG. 11B. In FIG. 12, the vertical axis represents intensity of diffused reflection light, and it is indicated that density is lower as reflected light is stronger. Further, the horizontal axis represents the patch positions in the detection pattern Pt indicated by "0" to "6".

In FIG. 12, the intensity of reflected light has the maximum value at the position of PATCH 3. In this case, by utilizing the adjustment value "0" corresponding to the position of PATCH 3, an adjustment value equivalent to the nozzle resolution will be obtained. The adjustment value corresponds to the amount of shift between the reference pattern BP and the adjustment pattern AP in each patch position of FIG. 11B, that is, the amount of shift in the conveyance amount of the two conveyance rollers relative to the set conveyance amount. That is, the adjustment value is "−3" for PATCH 0, "−2" for PATCH 1, "−1" for PATCH 2, "0" for PATCH 3, "+1" for PATCH 4, "+2" for PATCH 5, and "+3" for PATCH 6.

Note that it is also possible to perform function approximation as illustrated with the curve in FIG. 12, so as to obtain an adjustment value based on the function approximation. That is, for intensity values of the reflected light at the seven patch positions that are obtained, an approximate curve will be obtained by use of the least squares method, for example. Further, the adjustment value corresponding to the position of the maximum value in the obtained approximate curve is derived and utilized. In this case, it is possible to obtain an adjustment value with an accuracy exceeding the nozzle resolution.

Although one band is printed by two passes in the present embodiment, there is not a limitation as such, and it is also possible that one band is printed by three or more passes. In this case, the positions of nozzles for printing the detection pattern Pt and the printing timing are appropriately adjusted according to the number of passes for forming one band. Further, the detection of the conveyance amount is not limited to the method of utilizing the detection pattern Pt. That is, it is also possible that an image capturing element is mounted on the carriage 3 or the like, so as to detect the conveyance amount by use of fine concavities and convexities or patterns on the surface of the print medium before and after conveyance.

Next, an explanation will be given the driving amounts of the conveyance motor 51 and the slitter driving motor 16 which will be obtained for correction based on the detection result of the detection pattern Pt. The driving amounts of the conveyance motor 51 and the slitter driving motor 16 are obtained based on the adjustment value, which is the detection result of the detection pattern Pt, and calculation formulas stored in advance. Note that, for example, in a case where the detection pattern Pt cannot be read, the driving amounts at that time will be maintained.

FIG. 13 is a diagram illustrating the calculation formulas for calculating the driving amount of the slitter driving motor 16 and the driving amount of the conveyance motor 51 corresponding to adjustment values. In FIG. 13, the conveyance command value as a drive signal for driving the slitter driving motor 16 and the conveyance motor 51 is "L", the preset driving amount of the slitter driving motor 16 is "S", and the driving amount of the conveyance motor 51 is "T". That is, the driving amounts S and T are the default driving amounts, that is, the driving amounts corresponding to the conveyance speeds which are set as the conveyance profile.

In a case where the shift of the detected conveyance amount is indicative of being less than the preset conveyance command value by X, that is, in a case where the amount of shift relative to the conveyance command value is "−X", the corrected driving amount Sc of the slitter driving motor 16 and the corrected driving amount Tc of the conveyance motor 51 will be calculated with the formulas below. Note that the amount of shift relative to the conveyance command value corresponds to the above-described adjustment value. Therefore, in this case, if the adjustment value is "−3", "−2", or "−1", the corrected driving amounts Sc and Tc will be calculated with the following formula (1) and formula (2).

$$Sc=(1+kX/L)S \quad (1)$$

$$Tc=(1+mX/L)T \quad (2)$$

That is, in the above formulas (1) and (2), a value corresponding to the ratio of the amount of shift "−X" to the conveyance command value L is added to the set driving amounts S and T at equivalent ratios. Note that k and m are coefficients that take into account the amount of slip of the slitter upper conveyance roller 320 and the conveyance roller 8 with the print medium, respectively. If the amount of slip is "0", k+m=1 is set, and, if the amount of slip is greater, k+m≥1 is set.

On the other hand, in a case where the shift of the detected conveyance amount is indicative of being more than the preset conveyance command value by X, that is, in a case where the amount of shift relative to the conveyance command value is "+X", the corrected driving amount Sc and the corrected driving amount Tc will be calculated with the formulas below. Therefore, in this case, if the adjustment value is "+1", "+2", or "+3", the corrected driving amounts Sc and Tc will be calculated with the following formula (3) and formula (4).

$$Sc=(1-kX/L)S \quad (3)$$

$$Tc=(1-mX/L)T \quad (4)$$

That is, in the above formulas (3) and (4), a value corresponding to the ratio of the amount of shift "+X" to the conveyance command value L is subtracted from the preset driving amounts S and T at equivalent ratios.

Note that the conveyance command value L is preset according to the printing mode. Further, the above-described formulas (1), (2), (3) and (4) are stored in advance in the ROM 412 or the like.

The tension of the print medium 1 between the conveyance roller 8 and the slitter upper conveyance roller 320, which are driven based on the corrected driving amounts Tc and Sc that are calculated in the above-described way, can maintain preferable cutting accuracy of the slitter 13, for example.

As explained above, in the printing apparatus 100 according to the first embodiment, the detection pattern Pt is formed on the outside of each of unit print areas printed by multiple passes in order to detect the shift of the conveyance amount between the two conveyance rollers. Note that the two conveyance rollers are the conveyance roller 8 and the slitter upper conveyance roller 320. Then, the formed detection pattern Pt is read, so that the driving amount of each of the above-described two conveyance rollers is corrected based on the detection result from the detection pattern Pt.

Accordingly, in the printing apparatus 100 according to the first embodiment, the print medium 1 is less likely to float or bend between the above-described two conveyance rollers, so that it is possible to suppress deterioration in the cutting accuracy of the slitter 13. Further, in a case where the shift of the conveyance amount between the two conveyance rollers is relatively small, the tension generated between the two conveyance rollers can be suppressed to be relatively low, so that it is possible to suppress deterioration in the conveyance accuracy of the print medium 1.

Further, the present embodiment has a configuration in which the print head 2 performs printing on the conveyed print medium 1 between the above-described conveyance rollers. Therefore, if the print medium floats or bend due to a change in the rigidity of the print medium, there is a possibility that the landing positions of ink are shifted and, as a result, density unevenness or a streak occurs in the printed image. Since floating or bending that occurs in the print medium is suppressed in the above-described way in the present embodiment, the shift in the landing positions of ink becomes less likely to occur and, as a result, it is possible to suppress the occurrence of density unevenness or a streak in the printed image.

Second Embodiment

Figure 14:
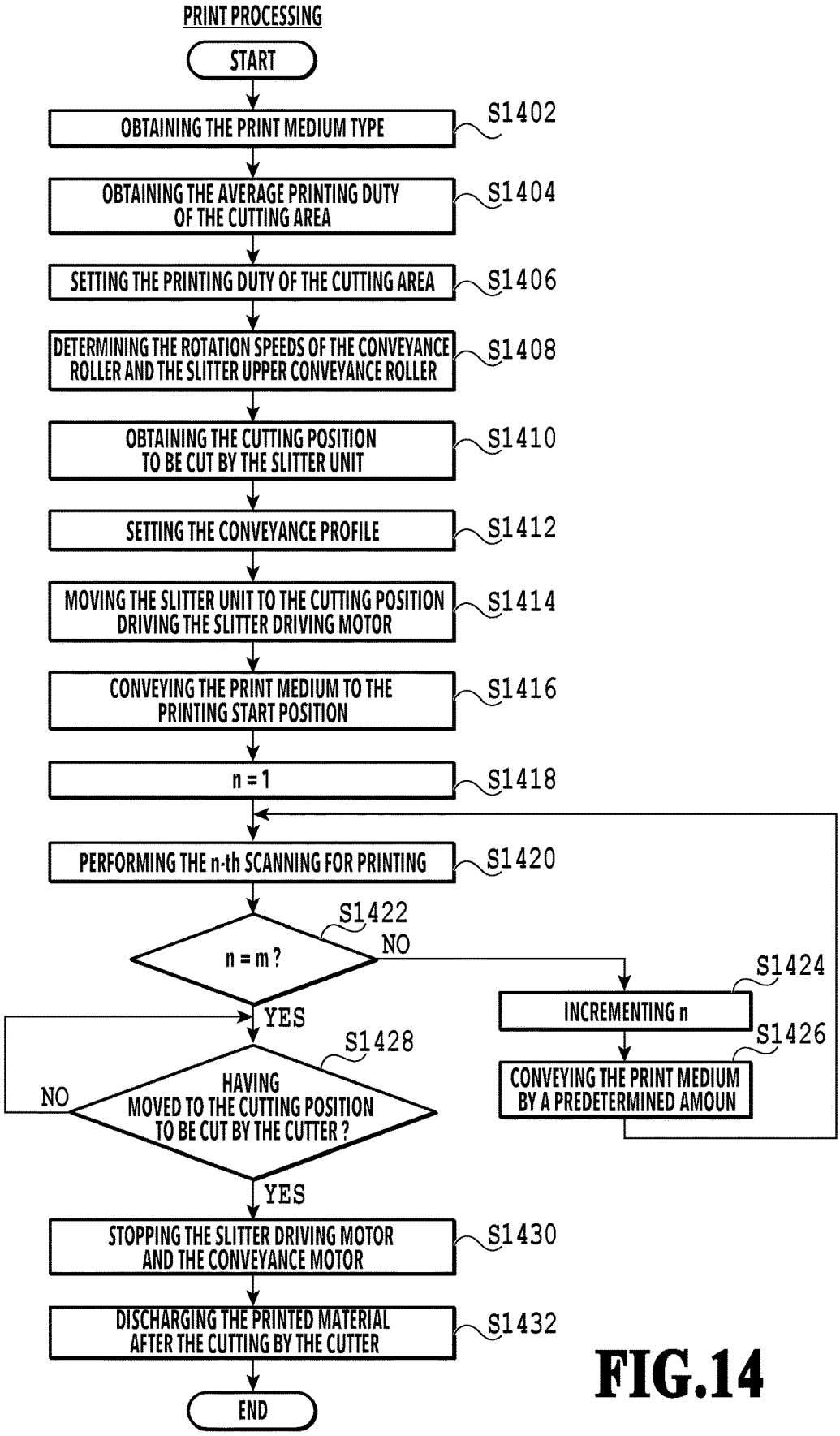
FIG. 14 is a flowchart of print processing to be executed by the printing apparatus according to the second embodiment.

Next, with reference to FIG. 14, FIG. 15A, and FIG. 15B, an explanation will be given of a printing apparatus according to the second embodiment. Note that, in the following explanation, the same or corresponding configurations as those of the first embodiment described above are assigned with the same reference signs as those used in the first embodiment, so as to omit the detailed explanations thereof.

The printing apparatus 100 according to the second embodiment is different from the above-described first embodiment in the aspects described below. That is, the ink application amount of an area in the vicinity of a cutting line to be cut by the slitter unit 303 in the print medium 1 including the cutting line is obtained, so that the conveyance amounts of the two conveyance rollers will be corrected according to the obtained ink application amount. In other words, in the present embodiment, the ink application amount of the cutting area in the image print area is obtained as the information related to the change in the rigidity of the print medium, so that the conveyance speeds of the two conveyance rollers will be corrected based on the information.

Floating and bending of the print medium 1 that occurs between the conveyance roller 8 and the slitter upper conveyance roller 320 as well as deterioration in the cutting accuracy of the slitter unit 303 in relation to the floating and bending are more prominent in such cases described below, for example. That is, the cases include a case in which a type of print medium having a low rigidity such as ordinary paper or thin coated paper is used as the print medium 1. Further, the cases include a case in which a large amount of ink is applied to an area in the vicinity of the cutting section to be cut by the slitter unit 303 in the print medium 1 and thus the rigidity of the print medium 1 is decreased due to the liquid component of the ink. Note that, since the cutting section to be cut by the slitter unit 303 in the print medium 1 is formed linearly along the Y direction, the cutting section is referred to as a "cutting line" in the following explanation.

Therefore, in the present embodiment, the rotation speed of the conveyance roller 8 and the rotation speed of the slitter upper conveyance roller 320 are corrected according to the rigidity of the print medium 1, and an appropriate tension is applied to the print medium 1, so that the cutting accuracy of the slitter unit 303 will be preferably maintained. Specifically, the rotation speeds of the two conveyance rollers are corrected based on the type of print medium and the ink application amount in the area in the vicinity of the cutting line.

Note that, if the tension to the print medium 1 is too high, there is an increased risk that the conveyance amount of the print medium 1 changes or the print medium 1 is obliquely conveyed, etc. Thus, the applied tension is set so as not to cause such problems. In the present embodiment, the conveyance speeds of the conveyance roller 8 and the slitter upper conveyance roller 320 are corrected by correcting the rotation speeds of the conveyance roller 8 and the slitter upper conveyance roller 320. That is, in the present embodiment, the rotation speeds are corrected as parameters related to the conveyance by the conveyance roller 8 and the slitter upper conveyance roller 320. Therefore, in the present embodiment, the conveyance speed of the print medium 1 with the two conveyance rollers is corrected by driving the conveyance motor 51 and the slitter driving motor 16 according to the correction of the rotation speeds of the conveyance roller 8 and the slitter upper conveyance roller 320.

More specifically, in the present embodiment, in a case where it is determined that the rigidity of the print medium 1 is less than a predetermined rigidity, a tension that is higher by a predetermined amount will be applied to the print medium 1, so as to suppress deterioration in the cutting accuracy of the slitter 13. Further, in a case where it is determined that the rigidity of the print medium 1 is equal to or higher than a predetermined rigidity, the minimum tension required to suppress floating or bending will be applied, so as to avoid deterioration in the conveyance accuracy of the two conveyance rollers.

The tension to be applied to the print medium 1 is adjusted by, for example, changing the ratio between the conveyance speed of the print medium 1 with the conveyance roller 8 and the conveyance speed of the print medium 1 with the slitter upper conveyance roller 320 of the slitter unit 303. Specifically, in the present embodiment, the rotation speed of the slitter upper conveyance roller 320 is changed. Further, the degree of rigidity of the print medium 1 is determined based on the type of print medium and the printing duty corresponding to the ink application amount, which are obtained from job data.

Further, the conveyance speed ratio between the conveyance roller 8 and the slitter unit 303 is determined so that an appropriate tension according to this degree of rigidity will be obtained. The conveyance speed ratio is a value obtained by dividing the conveyance speed (mm/s) of the slitter upper conveyance roller 320 by the conveyance speed (mm/s) of the conveyance roller 8. Then, based on the determined conveyance speed ratio, the rotation speed of the conveyance roller 8 and the rotation speed of the slitter upper conveyance roller 320 will be corrected.

Hereinafter, the print processing in the printing apparatus 100 according to the present embodiment will be explained. FIG. 14 is a flowchart illustrating the details of the print processing to be executed by the printing apparatus 100 according to the second embodiment. FIG. 15A is a diagram for explaining a cutting area. FIG. 15B is a diagram illustrating a parameter table. The series of the processes illustrated in the flowchart of FIG. 14 is performed by the CPU 411 loading a program code stored in the ROM 412 into the RAM 413 and executing the program code. Alternatively, a part or all of the functions in the steps of FIG. 14 may be executed by hardware such as an ASIC or an electronic circuit. Note that the reference sign "S" in the explanation of each process means that it is a step of the flowchart.

If the print processing is started, the CPU 411 firstly obtains information related to the print medium type, which indicates the type of the print medium 1, from job data which is output from a host apparatus (not illustrated in the drawings) (S1402). Subsequently, the CPU 411 obtains image data from the above-described job data, performs an analysis process on the image data, and obtains the average printing duty of the cutting area 1500, which is an area in the vicinity of the cutting lines to be formed by the slitter unit 303 in the print medium 1 including the cutting lines (S1404). The average printing duty is the ink application amount per unit area, and, in the present embodiment, a state in which one dot is formed with 4 pl of ink droplets on a 1200 dpi lattice is defined as 100%.

Specifically, the format of input image data is, for example, 8 bits each for RGB and a total of 24 bits. The CPU 411 performs color correction suitable to the characteristics of the image data and performs color conversion from the corrected RGB data into a total of 48 bits of six colors, i.e., 8 bits each for Bk, LC, C, LM, M, and Y, which are the ink colors to be used in the printing apparatus 100. The 8-bit value of each color in the data after the color conversion represents the printing duty of each ink color. That is, as for each 8-bit value, i.e., 0 to 255, "0" represents the printing duty of 0%, "255" represents the printing duty of 100%, and an intermediate value between 0 and 255 represents a duty value proportional to the intermediate value. Based on the data after the above-described color conversion, the CPU 411 calculates the average printing duty in the cutting area 1500.

Figures 15A, 15B:
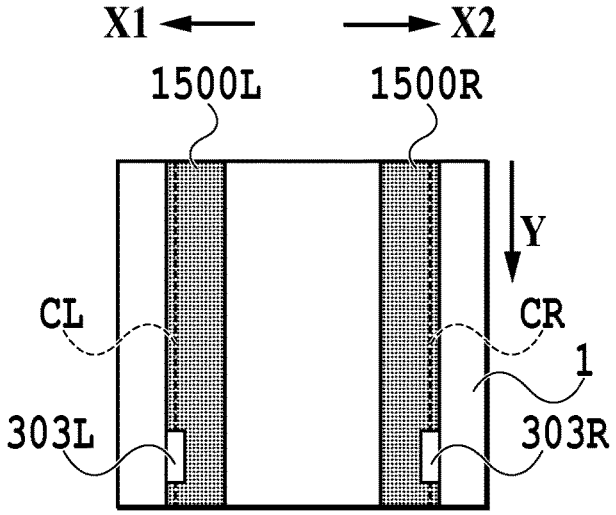
FIG. 15A and FIG. 15B are diagrams for explaining the method of determining the rotation speed of each conveyance roller in the print processing of FIG. 14.

The cutting area 1500 for which the average printing duty is obtained is the cutting area 1500R, which includes the cutting line CR of the slitter unit 303R, and the cutting area 1500L, which includes the cutting line CL of the slitter unit 303L (see FIG. 15A). That is, in S1404, the average printing duty DR of the cutting area 1500R and the average printing duty 1500DL of the cutting area 1500L are obtained.

In the present embodiment, the cutting area 1500R is a range of 100 mm inward (the X1 direction side) and 5 mm outward (the X2 direction side) in the width direction of the print medium 1 with reference to the cutting line CR of the slitter unit 303R. In the Y direction, the range in which the entire image based on the image data is printed is included. Further, the cutting area 1500L is a range of 100 mm inward (the X2 direction side) and 5 mm outward (the X1 direction side) in the width direction of the print medium 1 with reference to the cutting line CL of the slitter unit 303L. In the Y direction, as with the cutting area 1500R, the range in which the entire image based on the image data is printed is included. The positions of the cutting lines CR and CL of the slitter units 303R and 303L are obtained based on various kinds of information such as the print size which is included in the input job data.

Next, as the printing duty D of the cutting area, the CPU 411 sets a duty value indicating the higher value of the obtained average printing duty DR of the cutting area 1500R and average printing duty DL of the cutting area 1500L (S1406). Thereafter, the CPU 411 determines the rotation speed T1 of the conveyance roller 8 and the rotation speed T2 of the slitter upper conveyance roller 320, based on the information related to the print medium type, the printing duty D, and the parameter table 1502 (S1408).

The parameter table 1502 illustrated in FIG. 15B is stored in a storage area such as the ROM 412. The parameter table 1502 defines the print medium type, the printing duty D of the cutting area, and the conveyance speed ratio P, i.e., the relationship between the rotation speed T1 of the conveyance roller 8 and the rotation speed T2 of the slitter upper conveyance roller 320. In the parameter table 1502, the conveyance speed ratio P of the conveyance roller 8 and the slitter upper conveyance roller 320 becomes greater with an increase in the printing duty D. Note that the values and condition classifications illustrated in the parameter table 1502 are examples. That is, for example, the printing duty D, each of the rotation speeds, etc., are experimentally calculated according to the type of ink to be used and changed as appropriate. Further, the rotation speeds in the parameter table 1502 have such values at which a tension that can preferably maintain the cutting accuracy of the slitter 13 is generated to the print medium 1 between the two conveyance rollers and deterioration in the conveyance accuracy can be suppressed.

For example, the processing in S1408 in a case where the print medium type is coated paper will be explained. If the printing duty D is less than 100%, "1.01" is selected as the conveyance speed ratio P, and, in association with the conveyance speed ratio P, "2.00" is selected as the rotation speed T1 of the conveyance roller 8 and "2.02" is selected as the rotation speed T2 of the slitter upper conveyance roller 320. That is, in this case, the decrease in the rigidity of the print medium due to the liquid component of the ink is considered to be a negligible level. Further, if the printing duty D is 100% or more and less than 150%, "1.02" is selected as the conveyance speed ratio P, and, in association with the conveyance speed ratio P, "2.00" is selected as the rotation speed T1 and "2.04" is selected as the rotation speed T2. That is, in this case, it is considered that the rigidity of the print medium is decreased to a degree that cannot be ignored due to the liquid component of the ink. Furthermore, if the printing duty D is 150% or more, "1.03" is selected as the conveyance speed ratio P, and, in association with the conveyance speed ratio P, "2.00" is selected as the rotation speed T1 and "2.06" is selected as the rotation speed T2. That is, in this case, it is considered that the rigidity of the print medium is relatively greatly decreased to a degree that cannot be ignored due to the liquid component of the ink. By setting the rotation speed T1 of the conveyance roller 8 and the rotation speed T2 of the slitter upper conveyance roller 320 in this way, in a case where the printing duty D is high and the rigidity of the print medium 1 is decreased, it is possible to improve the tension of the print medium according to the decrease in the rigidity.

In the parameter table 1502, the conveyance speed ratio P is set to be greater for a print medium type whose rigidity is more likely to be decreased due to the liquid component of the ink. Specifically, even though the printing duty D is the same, in a case where the print medium is glossy paper, the range of the decrease in rigidity due to the liquid component of the ink is smaller than that of coated paper because of the thickness of the print medium. Therefore, if the print medium type is glossy paper, the conveyance speed ratio P in the case where the printing duty D is 150% or more is 1.02 and thus is smaller than 1.03 which is the conveyance speed ratio P in the case where the printing medium type is coated paper. Further, even though the printing duty D is the same, in a case where the print medium is ordinary paper, the range of the decrease in rigidity due to the liquid component of the ink is larger than that of coated paper because of the thinness of the print medium. Therefore, if the print medium type is ordinary paper, the conveyance speed ratio P in the case where the printing duty D is 150% or more is 1.04 and thus is greater than 1.03 which is the conveyance speed ratio P in the case where the printing medium type is coated paper.

Returning to FIG. 14, the explanation is continued. After S1408, the CPU 411 obtains a cutting position of the print medium 1 to be cut by the slitter unit 303 (S1410) and sets the conveyance profile (S1412). Since the specific details of processing of S1410 are the same as those of S902, the explanations thereof will be omitted. Further, in S1412, the setting is performed in the same manner as in S904. However, the conveyance speed is set based on the rotation speed T1 of the conveyance roller 8 and the rotation speed T2 of the slitter upper conveyance roller 320, which are obtained in S1408.

Next, the CPU 411 moves the slitter units 303L and 303R, based on the cutting position obtained in S1410, and drives the slitter driving motor 16 (S1414). Thereafter, the CPU 411 drives the conveyance roller 8 to convey the print medium 1 to the printing start position (S1416) and sets the variable "n" representing the scan count to "1" (S1418). Note that the specific details of processing of S1414 to S1418 are the same as those of S906 to S910 described above.

Then, the CPU 411 performs the n-th scanning to perform printing on the print medium (S1420). That is, in S1420, while moving the print head 2 in the X direction, ink is ejected from the print head 2 to apply the ink to the print medium 1. If the printing by the n-th scanning is ended, the CPU 411 subsequently determines whether or not n is equal to m (S1422), then increments n if it is determined that n is not equal to m (S1424), then conveys the print medium 1 by a predetermined amount (S1426), and then returns the processing to S1420. Note that the specific details of processing of S1422 are the same as those of S914 described above. Further, for the conveyance in S1426, the rotation speeds of the conveyance roller 8 and the slitter upper conveyance roller 320 determined in S1408 are reflected.

Further, if it is determined in S1422 that n is equal to m, the CPU 411 conveys the print medium 1 and determines whether or not the print medium 1 has moved to the position to be cut by the cutter 5 (S1428). In the conveyance of S1428, for example, the conveyance speeds (rotational speeds) during the conveyance operation is maintained. If it is determined in S1428 that the print medium 1 has moved to the position to be cut by the cutter 5, the CPU 411 stops the slitter driving motor 16 and the conveyance motor 51 (S1430). Thereafter, the CPU 411 drives the cutter motor 103 so that the cutter 5 cuts the print medium 1 in the X direction, then discharges the printed material (S1432), and then ends this print processing.

As described above, in the present embodiment, the rotation speeds of the conveyance roller 8 and the slitter upper conveyance roller 320 are determined based on the application amount of ink in the cutting area. Therefore, the printing apparatus 100 may employ a single-pass printing system, in which printing on a unit print area is performed by one pass, or employ a multi-pass printing system, in which printing on a unit print area is performed by multiple passes.

As explained above, in the printing apparatus 100 according to the second embodiment, the printing duty D is obtained as the ink application amount applied to the cutting area including the cutting line to be cut by the slitter unit 303 in the print medium 1. Further, the print medium type representing the type of the print medium 1 is obtained, so that the rotation speed T1 of the conveyance roller 8 and the rotation speed T2 of the slitter upper conveyance roller 320 are obtained from the parameter table 1502, based on the printing duty D and the print medium type. Further, when the print medium 1 is conveyed, the conveyance roller 8 and the slitter upper conveyance roller 320 are controlled based on the obtained rotation speeds.

Accordingly, as with the above-described first embodiment, the printing apparatus 100 according to the second embodiment can also suppress deterioration in the cutting accuracy of the slitter 13 and suppress occurrence of density unevenness and a streak in the printed image. Further, since it is possible to suppress the tension generated between the two conveyance rollers in a case where the printing duty D is relatively low, it is possible to suppress deterioration in the conveyance accuracy of the print medium 1.

Third Embodiment

Figures 16, 16A:
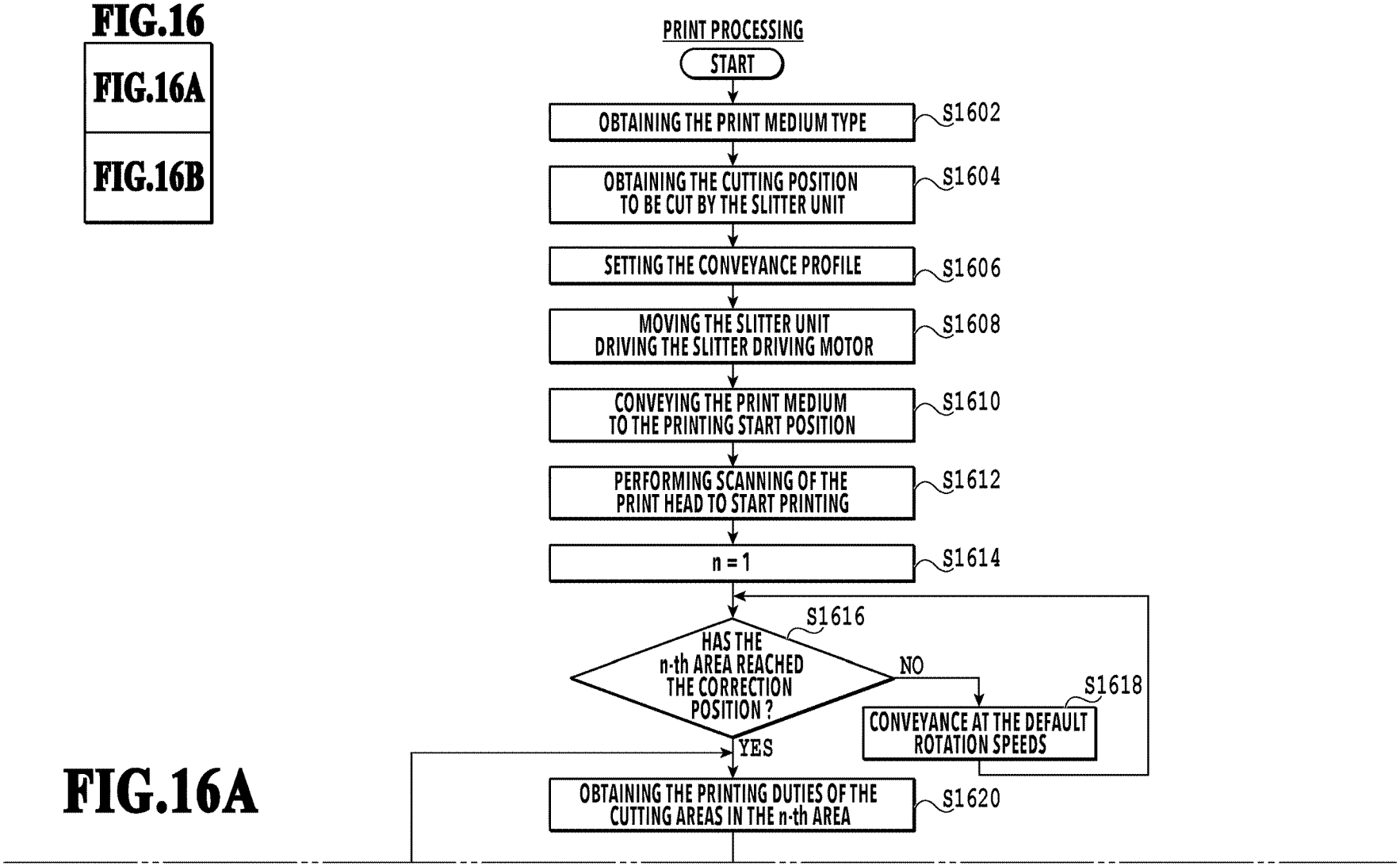
FIG. 16 is a diagram showing a relation between FIGS. 16A and 16B.
FIGS. 16A and 16B are flowcharts of print processing to be executed by the printing apparatus according to the third embodiment.

Next, with reference to FIG. 16, FIG. 17A, and FIG. 17B, an explanation will be given of a printing apparatus according to the third embodiment. Note that, in the following explanation, the same or corresponding configurations as those of the first embodiment described above are assigned with the same reference signs as those used in the first embodiment, so as to omit the detailed explanations thereof.

The printing apparatus 100 according to the third embodiment is different from the above-described first embodiment and second embodiment in the aspects described below. That is, as for a cutting area including a cutting line to be cut by the slitter unit 303 in the print medium 1, the ink application amount in each unit print area thereof is obtained, so that the conveyance by the conveyance mechanism in each unit print area is controlled according to the obtained ink application amount. In other words, in the present embodiment, the ink application amount of the cutting area in each unit print area is obtained as the information related to the change in the rigidity of the print medium, so that the conveyance speeds of the two conveyance rollers will be corrected based on the information. Note that, in the present embodiment, as with the above-described second embodiment, the printing apparatus 100 may employ a single-pass printing system, in which printing on a unit print area is performed by one pass, or employ a multi-pass printing system, in which printing on a unit print area is performed by multiple passes.

Figure 16B:
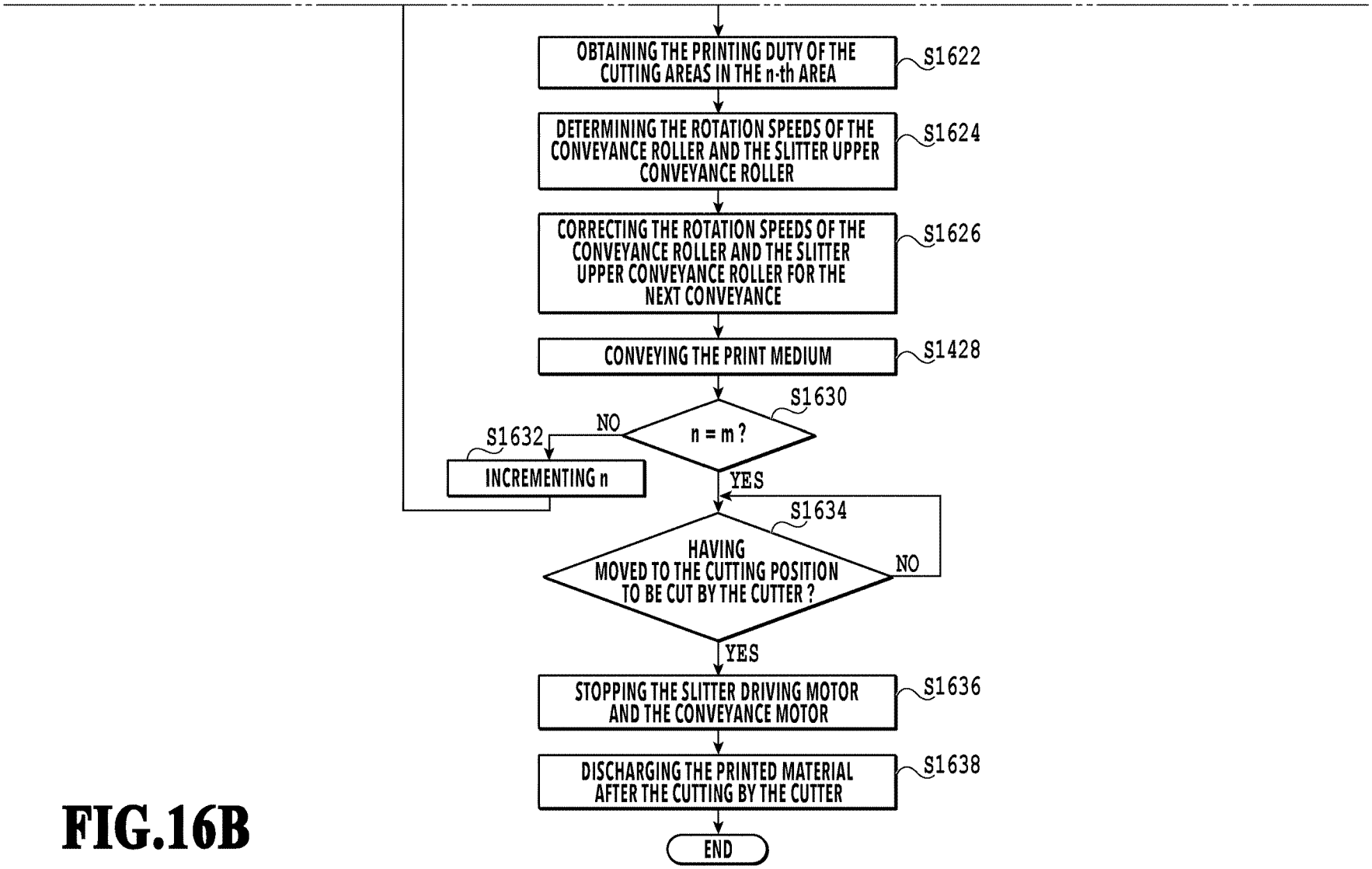

Hereinafter, the print processing in the printing apparatus 100 according to the present embodiment will be explained. FIGS. 16A and 16B are flowcharts illustrating the details of the print processing to be executed by the printing apparatus 100 according to the third embodiment. FIG. 17A is a diagram for explaining a cutting area. FIG. 17B is a diagram illustrating a parameter table. The series of the processes illustrated in the flowchart of FIGS. 16A and 16B is performed by the CPU 411 loading a program code stored in the ROM 412 into the RAM 413 and executing the program code. Alternatively, a part or all of the functions in the steps of FIGS. 16A and 16B may be executed by hardware such as an ASIC or an electronic circuit. Note that the reference sign "S" in the explanation of each process means that it is a step of the flowchart.

If the print processing is started, the CPU 411 firstly obtains information related to the print medium type, which indicates the type of the print medium 1, from job data which is output from a host apparatus (not illustrated in the drawings) (S1602). Further, the CPU 411 obtains the cutting position of the print medium 1 to be cut by the slitter unit 303 (S1604) and sets the conveyance profile (S1606). Since the specific details of processing of S1604 and S1606 are the same as those of S902 and S904 described above, the explanations thereof will be omitted.

Next, the CPU 411 moves the slitter units 303L and 303R, based on the cutting position obtained in S1604, and drives the slitter driving motor 16 (S1608). Thereafter, the CPU 411 drives the conveyance roller 8 to convey the print medium 1 to the printing start position (S1610) and performs scanning of the print head 2 to start printing (S1612). In S1612, the scan count is associated with the printed unit print area, so that it is possible to determine in what number of scanning the printing was performed. For example, the area printed by the t-th scanning is set as the t-th area. That is, the scan count and the unit print area are associated with each other.

Thereafter, the variable "n" representing the scan count of a printed unit print area is set to "1" (S1614). Then, whether or not the unit print area printed by the n-th scanning (hereinafter referred to as the "n-th area") has reached the correction position is determined (S1616). The correction position is a position where conveyance and cutting with the slitter unit 303 will be performed in the conveyance of the next conveyance operation (see FIG. 17A). Note that whether or not the unit print area has reached the correction position will be determined based on, for example, the conveyance amount from the printing position. If it is determined in S1616 that the n-th area has not reached the correction position, at the time of conveyance in the conveyance operation, the conveyance roller 8 and the slitter upper conveyance roller 320 are driven at the preset rotation speeds for the conveyance (S1618). Thereafter, the processing returns to S1616. Note that the preset rotation speeds are default rotation speeds corresponding to the conveyance speeds that are set as the conveyance profile.

Further, if it is determined in S1616 that the n-th area has reached the correction position, the CPU 411 obtains the image data from the job data, performs an analysis process on the image data, and obtains the average printing duty of the cutting area 1700*n* in the n-th area (S1620). In each unit print area, the cutting area 1700 is an area in the vicinity of a cutting line formed by the slitter unit 303 on the print medium 1 including the cutting line. Further, the cutting area 1700 is the cutting area 1700R, which includes the cutting line CR of the slitter unit 303R, and the cutting area 1700L, which includes the cutting line CL of the slitter unit 303L (see FIG. 17A). That is, in S1620, the average printing duty DRn of the cutting area 1700R and the average printing duty 1500DLn of the cutting area 1700L in the n-th area are obtained.

In the present embodiment, the cutting area 1700R is a range of 100 mm inward (the X1 direction side) and 5 mm outward (the X2 direction side) in the width direction of the print medium 1 with reference to the cutting line CR of the slitter unit 303R. In the Y direction, the length is the same as the conveyance amount in the conveyance operation. Further, the cutting area 1700L is a range of 100 mm inward (the X2 direction side) and 5 mm outward (the X1 direction side) in the width direction of the print medium 1 with reference to the cutting line CL of the slitter unit 303L. In the Y direction, the length is the same as the conveyance amount in the conveyance operation. Note that the range of the cutting areas 1700R and 1700L in the width direction of the print medium 1 is not limited to the above description, and the range is appropriately changed according to the type of ink to be used, for example.

Next, as the printing duty Dn of the cutting area in the n-th area, the CPU 411 sets a duty value indicating the higher value of the average printing duty DRn of the cutting area 1700R and average printing duty DLn of the cutting area 1700L in the n-th area (S1622). Thereafter, the CPU 411 determines the rotation speed T1 of the conveyance roller 8 and the rotation speed T2 of the slitter upper conveyance roller 320, based on the information related to the print medium type, the printing duty Dn, and the parameter table 1702 (S1624).

Figures 17A, 17B:
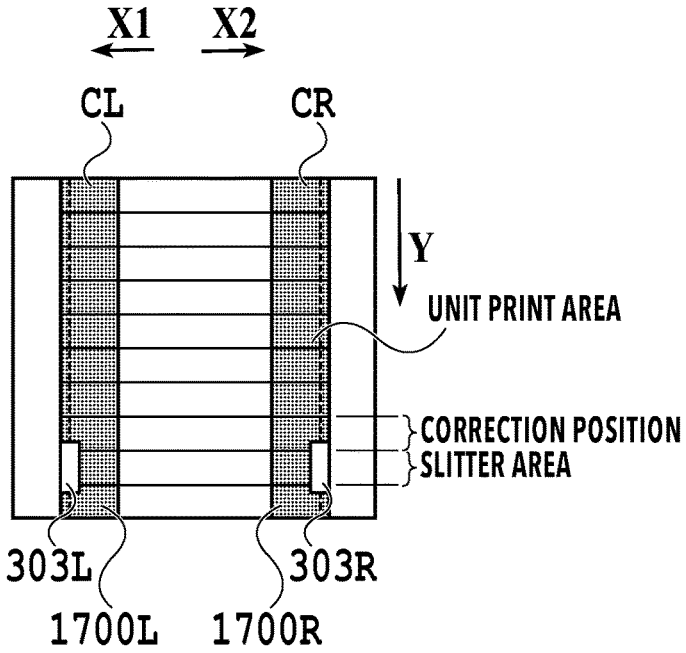
FIG. 17A and FIG. 17B are diagrams for explaining the method of determining the rotation speed of each conveyance roller in the print processing of FIGS. 16A and 16B.

The parameter table 1702 illustrated in FIG. 17B is stored in a storage area such as the ROM 412. The parameter table 1702 defines the print medium type, the printing duty Dn of the cutting area in the n-th area, and the conveyance speed ratio P, i.e., the relationship between the rotation speed T1 of the conveyance roller 8 and the rotation speed T2 of the slitter upper conveyance roller 320. In the parameter table 1702, as in the parameter table 1502, the conveyance speed ratio P of the conveyance roller 8 and the slitter upper conveyance roller 320 becomes greater with an increase in the printing duty Dn of the cutting area. Note that the rotation speeds in the parameter table 1702 have such values at which a tension that can preferably maintain the cutting accuracy of the slitter 13 is generated to the print medium 1 between the two conveyance rollers and deterioration in the conveyance accuracy can be suppressed. In S1624, the rotation speeds T1 and T2 of the conveyance roller 8 and the slitter upper conveyance roller 320 are obtained from the parameter table 1702, based on the information related to the print medium and the printing duty Dn.

Thereafter, the CPU 411 corrects (updates) the rotation speeds T1 and T2 of the conveyance roller 8 and the slitter upper conveyance roller 320 for the conveyance of the print medium 1 in the next conveyance operation to the values determined in S1624 (S1626). The next conveyance operation is a conveyance operation in which the n-th area is conveyed from the correction position to the area where the slitter unit 303 is located. Then, at the time of the next conveyance operation, the CPU 411 conveys the print medium 1 (S1628), then determines whether or not n is equal to m (S1630), then increments n if it is determined that n is not equal to m (S1632), and then returns the processing to S1620. Note that the specific details of processing of S1630 are the same as those of S914 described above.

Further, if it is determined in S1630 that n is equal to m, the CPU 411 conveys the print medium 1 and determines whether or not the print medium 1 has moved to the position to be cut by the cutter 5 (S1634). Note that the specific details of processing of S1634 are the same as those of S920 described above. If it is determined in S1634 that the print medium 1 has moved to the position to be cut by the cutter 5, the CPU 411 stops the slitter driving motor 16 and the conveyance motor 51 (S1636). Thereafter, the CPU 411 drives the cutter motor 103 so that the cutter 5 cuts the print medium 1 in the X direction, then discharges the printed material (S1638), and then ends this print processing.

Note that, in the above-described print processing, although the printing duty Dn of the cutting area 1700 in the n-th area is obtained and the rotation speeds of the two conveyance rollers are determined by use of the parameter table 1702 after it is determined that the n-th area has reached the correction position, there is not a limitation as such. That is, it is also possible that the rotation speeds of the conveyance roller 8 and the slitter upper conveyance roller 320 for the conveyance up to the slitter area (see FIG. 17A), in which each unit print area is conveyed and cut by the slitter unit 303, are obtained before the printing operation.

As explained above, in the printing apparatus 100 according to the third embodiment, the ink application amount of the cutting area 1700 is obtained in each unit print area printed by scanning of the print head 2, so as to obtain the rotation speeds of the two conveyance rollers. Then, when each unit print area is moved to the area to be conveyed and cut by the slitter unit 303, the conveyance roller 8 and the slitter upper conveyance roller 320 are driven at the rotation speeds obtained for each unit print area. Accordingly, it is also possible to obtain the same functional effects as in the above-described first and second embodiments in the printing apparatus 100 according to the third embodiment. Further, since the cutting area is more finely divided in the conveyance direction as compared with the above-described second embodiment, deterioration in the cutting accuracy of the slitter 13 can be suppressed more appropriately.

Fourth Embodiment

Next, with reference to FIG. 18A to FIG. 20, an explanation will be given of a printing apparatus according to the fourth embodiment. Note that, in the following explanation, the same or corresponding configurations as those of the first embodiment described above are assigned with the same reference signs as those used in the first embodiment, so as to omit the detailed explanations thereof.

The printing apparatus 100 according to the fourth embodiment is different from the above-described first, second, and third embodiments in an aspect that the rotation speeds of the conveyance roller 8 and the slitter upper conveyance roller 320 are set according to a margin setting included in job data. That is, in the present embodiment, the margin setting is obtained as the information related to the change in the rigidity of the print medium, so that the conveyance speeds of the two conveyance rollers will be corrected based on the information.

Figure 18A:
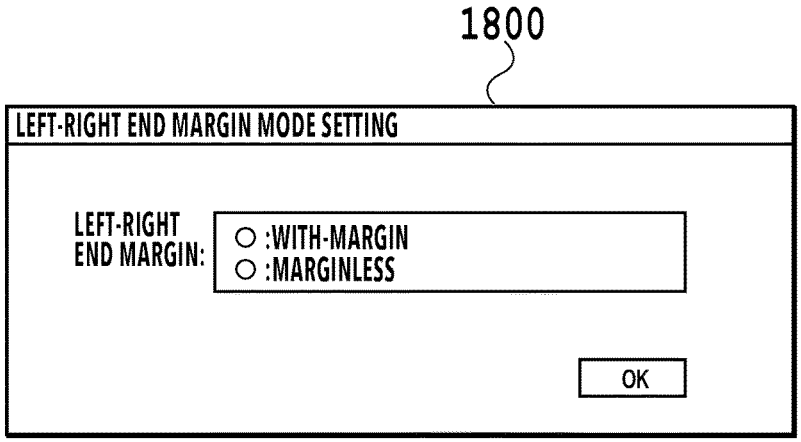
FIG. 18A to FIG. 18C are diagrams for explaining a margin setting.
Figure 18B:
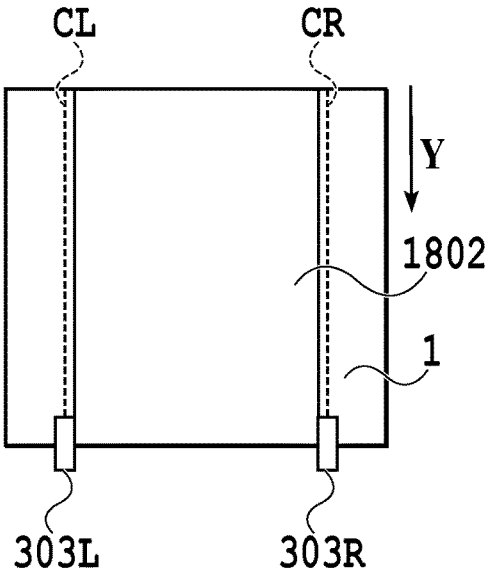
Figure 18C:
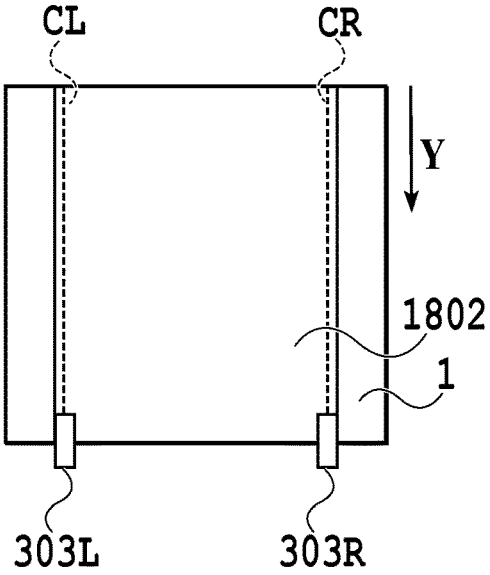

In the printing apparatus 100, it is possible to perform a margin setting for setting the presence or absence of a margin on the left and right sides of a printed image which is a product. FIG. 18A to FIG. 18C are diagrams for explaining the margin setting. FIG. 18A is a diagram illustrating a left-right edge margin mode setting screen for the margin setting. FIG. 18B is a diagram illustrating the position of the cutting line in a case where "with-margin" is set. FIG. 18C is a diagram illustrating the position of the cutting line in a case where "marginless" is set.

In the printing apparatus 100, the left-right end margin mode setting screen 1800 for performing the margin setting is displayed on a host apparatus (not illustrated in the drawings) or an operation part (not illustrated in the drawings). On the displayed setting screen 1800, the user can set "with-margin", in which a margin is formed on the left and right sides of the printed image, or "marginless", in which a margin is not formed on the left and right sides of the printed image.

If "with-margin" is set on the setting screen 1800, the image print area 1802 in the print medium 1 is located inside the cutting lines CL and CR, which are to be cut by the slitter units 303L and 303R. Therefore, if "with-margin" is set, a printed material having a margin of several mm formed on both left and right sides of the image print area can be obtained. Further, if "marginless" is set on the setting screen 1800, left and right end portions of the image print area 1802 in the print medium 1 are located outside the cutting lines CL and CR, which are to be cut by the slitter units 303L and 303R. Therefore, if "marginless" is set, a printed material in which a margin is not formed on both left and right sides of the image print area can be obtained.

Figure 19:
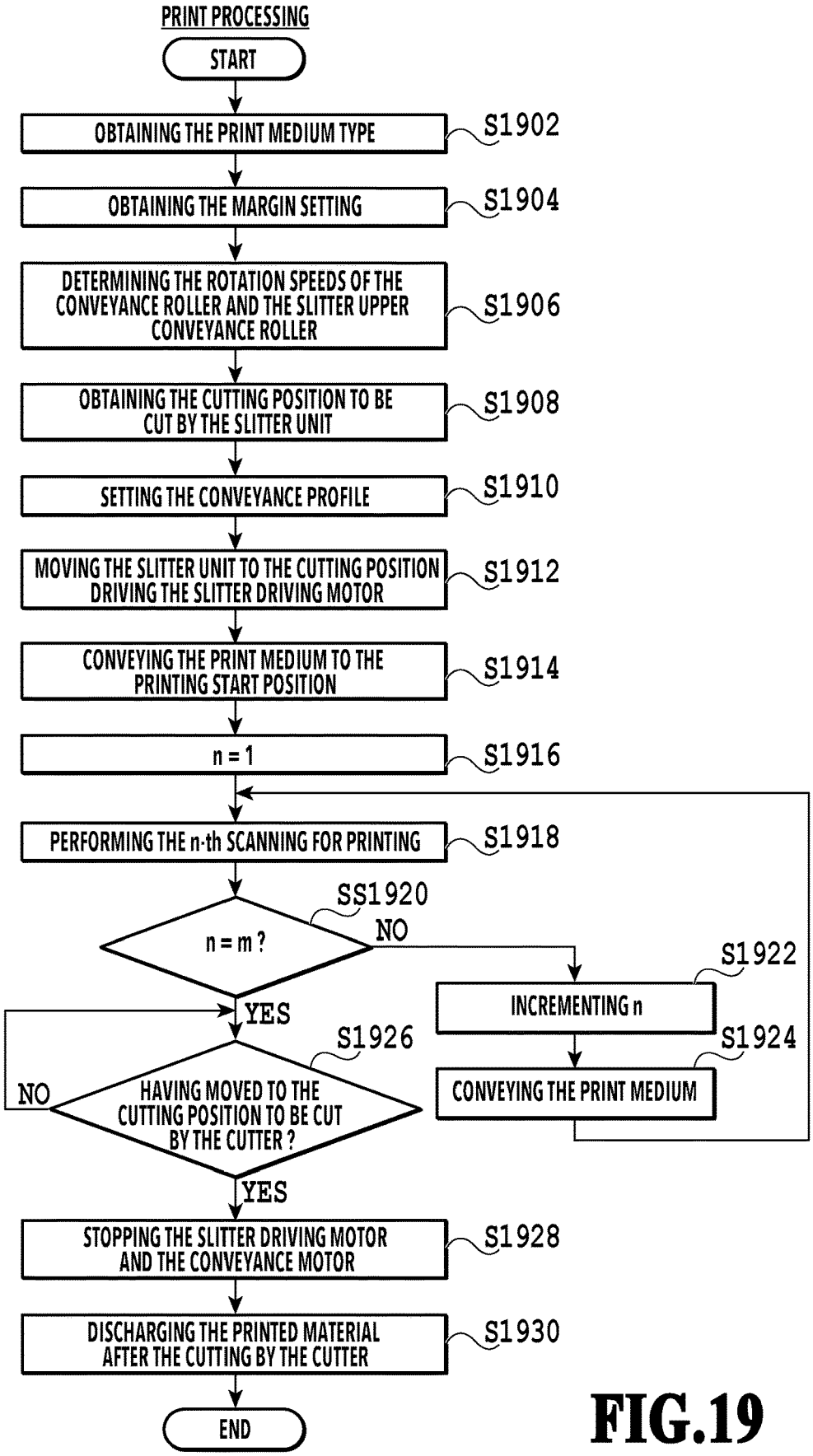
FIG. 19 is a flowchart of print processing to be executed by the printing apparatus according to the fourth embodiment.

Next, the print processing in the printing apparatus 100 according to the present embodiment will be explained. FIG. 19 is a flowchart illustrating the details of the print processing to be executed by the printing apparatus 100 according to the fourth embodiment. FIG. 20 is a diagram illustrating a parameter table. The series of the processes illustrated in the flowchart of FIG. 19 is performed by the CPU 411 loading a program code stored in the ROM 412 into the RAM 413 and executing the program code. Alternatively, a part or all of the functions in the steps of FIG. 19 may be executed by hardware such as an ASIC or an electronic circuit. Note that the reference sign "S" in the explanation of each process means that it is a step of the flowchart.

If the print processing is started, the CPU 411 firstly obtains information related to the print medium type, which indicates the type of the print medium 1, from the job data which is output from a host apparatus (not illustrated in the drawings) (S1902). Subsequently, the CPU 411 obtains the setting information of the margin setting from the job data or input information (S1904). That is, in S1904, the setting information of the margin setting that is included in the job data, which is set in a host apparatus, or the setting information of the margin setting that is input via an operation part is obtained. The setting information of the margin setting is the setting of "with-margin" or "marginless".

Next, the CPU 411 determines the rotation speed T1 of the conveyance roller 8 and the rotation speed T2 of the slitter upper conveyance roller 320, based on the information related to the print medium type, the setting information of the margin setting, and the parameter table 2000 (S1906). The parameter table 2000 illustrated in FIG. 20 is stored in a storage area such as the ROM 412. The parameter table 2000 defines the print medium type, the setting information of the margin setting, and the conveyance speed ratio P, i.e., the relationship between the rotation speed T1 of the conveyance roller 8 and the rotation speed T2 of the slitter upper conveyance roller 320. In the parameter table 2000, in a case where the margin setting is "marginless", the conveyance speed ratio P of the conveyance roller 8 and the slitter upper conveyance roller 320 becomes greater, as compared to a case of "with-margin". Further, in the parameter table 2000, the conveyance speed ratio P is set to be greater for a print medium whose rigidity is more likely to change due to the liquid component of the ink. The values illustrated in the parameter table 2000 are examples. Note that the rotation speeds in the parameter table 2000 have such values at which a tension that can preferably maintain the cutting accuracy of the slitter 13 is generated to the print medium 1 between the two conveyance rollers and deterioration in the conveyance accuracy can be suppressed.

Thereafter, the CPU 411 obtains the cutting position of the print medium 1 to be cut by the slitter unit 303 (S1908) and sets the conveyance profile (S1910). Since the specific details of processing of S1908 are the same as those of S902, the explanations thereof will be omitted. Further, in S1910, the setting is performed in the same manner as in S904. However, the conveyance speeds are set based on the rotation speed T1 of the conveyance roller 8 and the rotation speed T2 of the slitter upper conveyance roller 320, which are obtained in S1906.

Then, the CPU 411 moves the slitter units 303L and 303R, based on the cutting position obtained in S1908, and drives the slitter driving motor 16 (S1912). Thereafter, the CPU 411 drives the conveyance roller 8 to convey the print medium 1 to the printing start position (S1914) and sets the variable "n" representing the scan count to "1" (S1916). Note that the specific details of processing of S1912 to S1916 are the same as those of S906 to S910 described above.

Next, the CPU 411 performs the n-th scanning to perform printing on the print medium 1 (S1918). That is, in S1918, while moving the print head 2 in the X direction, ink is ejected from the print head 2 to apply the ink to the print medium 1. If the printing by the n-th scanning is ended, the CPU 411 subsequently determines whether or not n is equal to m (S1920), then increments n if it is determined that n is not equal to m (S1922), then conveys the print medium 1 by a predetermined amount (S1924), and then returns the processing to S1918. Note that the specific details of processing of S1920 are the same as those of S914 described above. Further, for the conveyance in S1924, the rotation speeds of the conveyance roller 8 and the slitter upper conveyance roller 320 determined in S1906 are reflected.

Further, if it is determined in S1920 that n is equal to m, the CPU 411 conveys the print medium 1 and determines whether or not the print medium 1 has moved to the position to be cut by the cutter 5 (S1926). Note that the specific details of processing of S1926 are the same as those of S920 described above. If it is determined in S1926 that the print medium 1 has moved to the position to be cut by the cutter 5, the CPU 411 stops the slitter driving motor 16 and the conveyance motor 51 (S1928). Thereafter, the CPU 411 drives the cutter motor 103 so that the cutter 5 cuts the print medium 1 in the X direction, then discharges the printed material (S1930), and then ends this print processing.

As explained above, in the printing apparatus 100 according to the fourth embodiment, the rotation speeds of the two conveyance rollers are obtained from the parameter table according to the type of the print medium 1 and the setting of "with-margin" or "marginless", which is for setting the presence or absence of a margin on the left and right sides of the printed material. This parameter table is set so that, for each type of print medium, the tension of the print medium 1 generated between the two conveyance rollers becomes higher in a case of the "with-margin" setting, as compared to a case of the "marginless" setting.

Accordingly, as with the above-described first embodiment, the printing apparatus 100 according to the fourth embodiment can also suppress deterioration in the cutting accuracy of the slitter 13 and suppress occurrence of density unevenness and a streak in the printed image. Further, since the decrease in rigidity due to application of ink is relatively low at the time of the "with-margin" setting, it is possible to suppress the tension of the print medium 1 between the two conveyance rollers and thus deterioration in the conveyance accuracy can be suppressed.

Other Embodiments

Note that the above-described embodiments may be modified as shown in the following (1) through (12).

(1) Although not particularly described in the first embodiment, it is also possible that the corrected driving amounts Sc and Tc are adjusted according to a use amount of the slitter unit 303. That is, there is a possibility that the resistance force in the cutting part 60 decreases according to a use amount (the number of times of usage, the distance of usage) of the slitter unit 303 as well, and thus the conveyance amount may change accordingly. Therefore, for example, it is also possible that such a correction table in which the driving amounts Sc and Tc calculated with the above-described formulas (1) to (4) change according to a use amount of the slitter unit 303 is held, so that the corrected driving amounts Sc and Tc are adjusted according to this correction table. Note that the adjustment method is not limited to the correction table, and it is also possible to use a calculation formula with which the corrected driving amounts Sc and Tc according to a use amount of the slitter unit 303 can be obtained. Further, also in the above-described second, third, and fourth embodiments, it is possible that the obtained rotation speeds T1 and T2 of the conveyance roller 8 and the slitter upper conveyance roller 320 are similarly adjusted according to a use amount of the slitter unit 303. In addition, since there is a possibility that the rigidity of the print medium changes according to the external environment such as temperature and humidity, it is also possible that the corrected driving amounts Sc and Tc and rotation speeds T1 and T2 are adjusted by use of a correction table or a calculation formula according to the external environment.

(2) In the above-described first embodiment, although the detection pattern Pt is formed in a margin area on one side or the other side of the print medium with respect to the X direction, there is not a limitation as such. That is, in a case where there is a margin area in which the detection pattern Pt can be formed on one side and the other side of an image print area, it is also possible to form the detection pattern Pt on both of the one side and the other side of the image print area. In this case, it becomes possible to respectively detect shifts in conveyance amounts on the one side and the other side with respect to the X direction. Therefore, it is also possible that the driving amounts Sc and Tc on the one side and the other side are separately obtained based on the shifts in conveyance amounts on the one side and the other side.

(3) In the above-described first embodiment, although the driving amount of the conveyance motor 51 and the driving amount of the slitter driving motor 16 are corrected, there is not a limitation as such. That is, it is also possible that either one of the driving amount of the conveyance motor 51 and the driving amount of the slitter driving motor 16 is corrected. In the above-described first embodiment, although the detection pattern Pt is formed and read for each unit print area, there is not a limitation as such. That is, it is also possible that the detection pattern Pt is formed and read for each group of multiple unit print areas. Accordingly, the time period required for printing can be suppressed.

(4) Although not particularly described in the first embodiment, it is also possible that, not only the detection pattern Pt, various adjustment patterns are printed in a margin area of the print medium 1. Examples of such adjustment patterns include a pattern for color deviation correction, a pattern with which clogging or the like of a nozzle can be detected, a pattern with which a shift in a printing position of a print head can be detected.

(5) Although not particularly described in the second and third embodiments, it is also possible that the printing apparatus 100 can set marginless printing or with-margin printing, and the print processing explained in the embodiments will be executed only in a case where the marginless printing in which the cutting line is located inside an image print area is set. That is, in this case, if the with-margin printing in which the cutting line is located outside an image print area is set, the conveyance roller 8 and the slitter upper conveyance roller 320 will be driven at default rotation speeds in the conveyance operation. Further, although not particularly described in the second and third embodiments, it is also possible that the conveyance roller 8 and the slitter upper conveyance roller 320 are driven at default rotation speeds during the time of cutting the leading edge section of the print medium 1 in which no printed image is printed.

(6) In the above-described second and third embodiments, although a printing duty is used as an ink application amount, there is not a limitation as such. That is, it is also possible to use a total dot number in the cutting area 1500 or 1700 or an average value of the dot numbers respectively applied to predetermined areas in the cutting area, so it is possible to use any value as long as the value can be used for comparison of the application amount of ink to the cutting area 1500 or 1700.

(7) In the above-described second and third embodiments, although the area for calculating the printing duty is 100 mm inward and 5 mm outward with reference to the cutting lines CL and CR, there is not a limitation as such. That is, the floating behavior of a print medium due to an application of ink changes according to the configuration of the conveyance path in the printing apparatus 100. Therefore, it is also possible that the size and position of the area for calculating the printing duty are appropriately set according to the configuration of the conveyance path. Further, it is also possible that the size and position of the area for calculating the printing duty are set according to the type of print medium, the type of ink, etc.

(8) In the above-described second and third embodiments, although the average printing duties in the left and right cutting areas are calculated, so that the one having the higher value of the average printing duties is adopted as the printing duty and the rotation speeds of the two conveyance rollers are determined based on this printing duty, there is not a limitation as such. That is, it is also possible that the rotation speeds of the conveyance roller 8 and the slitter upper conveyance roller 320 are determined for each of the left and right sides of the print medium 1, based on the left and right average printing duties. Accordingly, the conveyance amounts of the print medium 1 will be separately controlled on the left and right sides of an image print area.

(9) In the above-described embodiments, although the printing apparatus 100 is what is termed as a serial scan type in which printing is performed while performing scanning of the print head 2 via the carriage 3, there is not a limitation as such. That is, it is also possible to use a full-line type printing apparatus in which a print head equipped with a nozzle row having a length corresponding to the size of a print medium in the width direction is fixedly arranged. Further, in the above-described embodiments, although the printing apparatus 100 is equipped with the print head 2, there is not a limitation as such. That is, the above-described embodiments can be applied to a conveyance apparatus capable of cutting a print medium along a conveyance direction. Furthermore, in the above-described embodiments, although the slitter 13 includes the slitter units 303L and 303R, there is not a limitation as such. That is, it is also possible that the slitter 13 is only equipped with either one of the slitter units 303L and 303R.

(10) In the above-described embodiments, although the control part 410 of the printing apparatus 100 obtains a shift in the conveyance amount of the conveyance roller 8 and the slitter upper conveyance roller 320 and calculates a printing duty, there is not a limitation as such. That is, it is also possible that these processes are executed by an external apparatus such as a host apparatus, based on information from the printing apparatus 100, for example. Further, in the above-described embodiments, although the slitter 13 includes the two slitter units 303L and 303R, there is not a limitation as such. That is, there may be such a form in which the slitter 13 is equipped with one slitter unit 303. In this case, with respect to the X direction, a slitter conveyance roller is disposed on the other side, where the slitter unit 303 is not located.

(11) In the above-described embodiments, although a rotation speed, i.e., a conveyance amount per unit of time is adjusted, there is not a limitation as such. That is, there may be such a form in which a conveyance amount is adjusted relative to a conveyance amount in a conveyance operation according to the length of a unit print area in the Y direction. Further, in the above-described embodiments, although a print medium is conveyed by the conveyance roller 8 and the slitter upper conveyance roller 320, there is not a limitation as such. That is, as the conveyance unit for conveying a print medium, various publicly-known conveyance units, such as one that utilizes a belt, may be used.

(12) The above-described embodiments and various forms shown in (1) through (11) may be combined as appropriate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-156363, filed Sep. 17, 2020, which is hereby incorporated by reference herein in its entirety.

What is claimed is:

1. A printing apparatus comprising:

a first conveyance unit configured to convey a print medium in a conveyance direction;

a printing unit configured to print an image by applying ink to the print medium conveyed by the first conveyance unit;

a cutting unit disposed on a downstream side of the printing unit in the conveyance direction and configured to cut the print medium, which is conveyed by the first conveyance unit, along the conveyance direction;

a second conveyance unit disposed on the cutting unit; and a correction unit configured to correct a parameter related to conveyance of the second conveyance unit, based on information obtained by reading a detection pattern which is printed by the printing unit.

2. The printing apparatus according to claim 1, wherein the information is information related to a change in rigidity.

3. The printing apparatus according to claim 2, wherein the correction unit further corrects the parameter based on information which is a setting of marginless, which is for cutting an inside of an image print area in which an image based on image data is printed, or with-margin, which is for cutting an outside of the image print area.

4. The printing apparatus according to claim 3, wherein the correction unit corrects a ratio of a conveyance speed of the second conveyance unit to a conveyance speed of the first conveyance unit so that the ratio increases in a case where the setting is marginless, as compared to a case where the setting is with-margin.

5. The printing apparatus according to claim 1, wherein the detection pattern is printed together with an image printed based on image data.

6. The printing apparatus according to claim 5, wherein the detection pattern is a pattern whose lightness changes in a case where a conveyance amount of the first conveyance unit and the second conveyance unit change.

7. The printing apparatus according to claim 5, wherein the cutting unit is disposed at two locations in a width direction of the print medium, the width direction intersecting the conveyance direction, and wherein the detection pattern is formed on at least one side in the width direction, the one side being outside an image print area in which the image based on the image data is printed.

8. The printing apparatus according to claim 2, wherein the correction unit further corrects the parameter based on information which is an ink application amount for a cutting area in a vicinity of a cutting section to be cut by the cutting unit, the cutting area including the cutting section.

9. The printing apparatus according to claim 8, wherein the cutting area is divided in the conveyance direction, and the information is an ink application amount for each area obtained by the division.

10. The printing apparatus according to claim 8, wherein the cutting unit is disposed at two locations in a width direction of the print medium, the width direction intersecting the conveyance direction, and wherein the information is a greater ink application amount of the two cutting areas.

11. The printing apparatus according to claim 9, wherein the cutting unit is disposed at two locations in a width direction of the print medium, the width direction intersecting the conveyance direction, and wherein the information is a greater ink application amount of the two cutting areas which are located at both ends of an area obtained by the division in the width direction.

12. The printing apparatus according to claim 8, wherein the correction unit corrects a ratio of a conveyance speed of the second conveyance unit to a conveyance speed of the first conveyance unit so that the ratio increases according to an increase in the ink application amount in the cutting area.

13. The printing apparatus according to claim 8, wherein the ink application amount is a printing duty which indicates an application amount of ink for a unit area in the cutting area.

14. The printing apparatus according to claim 8, wherein the correction unit further corrects the parameter based on information which includes a type of print medium.

15. The printing apparatus according to claim 14, wherein the correction unit corrects a ratio of a conveyance speed of the second conveyance unit to a conveyance speed of the first conveyance unit so that the ratio increases according to a decrease in rigidity of the type of print medium due to a liquid component of ink.

16. The printing apparatus according to claim 1, wherein the correction unit adjusts a corrected value according to a use amount of the cutting unit.

17. The printing apparatus according to claim 1, wherein the first conveyance unit and the second conveyance unit are conveyance rollers, respectively, and wherein the parameter is a rotation speed of each of the conveyance rollers.

18. A printing apparatus comprising:

a first conveyance unit configured to convey a print medium in a conveyance direction;

a printing unit configured to print an image by applying ink to the print medium conveyed by the first conveyance unit;

a cutting unit disposed on a downstream side of the printing unit in the conveyance direction and configured to cut the print medium, which is conveyed by the first conveyance unit, along the conveyance direction;

a second conveyance unit disposed on the cutting unit; and a correction unit configured to correct a parameter related to conveyance of at least one of the first conveyance unit and the second conveyance unit, based on information about the print medium, wherein the parameter is driving amounts of a first driving unit that drives the first conveyance unit and a second driving unit that drives the second conveyance unit.

19. The printing apparatus according to claim 1, wherein the correction unit corrects a parameter related to conveyance of the first conveyance unit, based on information obtained by reading the detection pattern which is printed by the printing unit.

20. A control method of a printing apparatus, the printing apparatus including: (a) a first conveyance unit configured to convey a print medium in a conveyance direction; (b) a printing unit configured to print an image on the print medium conveyed by the first conveyance unit; (c) a cutting unit disposed on a downstream side of the printing unit in the conveyance direction and configured to cut the print medium, which is conveyed by the first conveyance unit, along the conveyance direction; and (d) a second conveyance unit disposed on the cutting unit, the control method comprising a correction step for correcting a parameter related to conveyance of the second conveyance unit, based on information obtained by reading a detection pattern which is printed by the printing unit.

21. The control method according to claim 20, wherein the detection pattern is printed together with an image printed based on image data.

22. The control method according to claim 21, wherein the detection pattern is a pattern whose lightness changes in a case where a conveyance amount of the first conveyance unit and the second conveyance unit change.

23. The control method according to claim 21, wherein the cutting unit is disposed at two locations in a width direction of the print medium, the width direction intersecting the conveyance direction, and wherein the detection pattern is formed on at least one side in the width direction, the one side being outside an image print area in which the image based on the image data is printed.

* * * * *